US007988269B2

(12) United States Patent
Murakami et al.

(10) Patent No.: US 7,988,269 B2
(45) Date of Patent: Aug. 2, 2011

(54) LIQUID DROPLET EJECTING DEVICE

(75) Inventors: Atsushi Murakami, Kanagawa (JP); Masashi Hiratsuka, Kanagawa (JP); Kishiharu Itazu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/632,880

(22) Filed: Dec. 8, 2009

(65) Prior Publication Data

US 2010/0079511 A1 Apr. 1, 2010

Related U.S. Application Data

(62) Division of application No. 11/592,607, filed on Nov. 3, 2006, now Pat. No. 7,669,990.

(30) Foreign Application Priority Data

Jun. 16, 2006 (JP) ..... 2006-166965

(51) Int. Cl.
*B41J 2/175* (2006.01)

(52) U.S. Cl. ..... 347/84

(58) Field of Classification Search ..... 347/36, 347/84, 85

See application file for complete search history.

(56) References Cited

U.S. PATENT DOCUMENTS 7,648,224 B2 * 1/2010 Sasa et al. ..... 347/36
2006/0061638 A1 3/2006 Amarume et al.

FOREIGN PATENT DOCUMENTS

JP 2006-326881 12/2006

* cited by examiner

*Primary Examiner* — An H Do
(74) *Attorney, Agent, or Firm* — Fildes & Outland, P.C.

(57) ABSTRACT

The present invention provides a liquid droplet ejecting device including a liquid droplet ejecting head; a liquid storage unit that stores a liquid; a first flow path and a second flow path that connect the liquid droplet ejecting head and the liquid storage unit, the second flow path connecting with the first flow path in the liquid droplet ejecting head; a bypass flow path connected with the first flow path and the second flow path; a liquid feed unit provided between the liquid storage unit and a connecting portion of the bypass flow path and the first flow path, and circulating the liquid in the liquid droplet ejecting head and the liquid storage unit, and a pressure control unit provided at the bypass flow path, and controlling pressure of the liquid flowing through the bypass flow path from the first flow path side to the second flow path side.

11 Claims, 19 Drawing Sheets

LIQUID DROPLET EJECTING DEVICE

CROSS-REFERENCE TO RELATED APPLICATION

This application is a division of U.S. application Ser. No. 11/592,607 filed Nov. 3, 2006 now U.S. Pat. No. 7,669,990.

BACKGROUND OF THE INVENTION

1. Technical Field

The present invention relates to a liquid droplet ejecting device that ejects liquid droplets.

2. Related Art

In a liquid droplet ejecting device such as an ink jet recording device or the like, ink droplets attach to around nozzles, and in some cases, ink ejecting direction is inclined, and the ink droplet diameters and ink droplet ejecting speeds become uneven. Therefore, at a specified time or at a specified number of paper sheets printed, printing is stopped and nozzle surfaces are cleaned.

As such an ink jet recording device, there is, for example, one where ink is swelled on the nozzle surface and wiped away. That is, if the nozzle surface is wiped in a state where the nozzle surface is dry, there is a fear that the nozzle surface may be damaged, therefore, ink is swelled on the nozzle surface before wiping it, thereby the nozzle surface is made wet, and it is prevented the nozzle surface from being damaged by wiping.

SUMMARY

According to an aspect of the invention, there is provided a liquid droplet ejecting device including: a liquid droplet ejecting head that ejects a liquid droplet from a nozzle; a liquid storage unit that stores a liquid to be supplied to the liquid droplet ejecting head; a first flow path that connects the liquid droplet ejecting head and the liquid storage unit; a second flow path that connects the liquid droplet ejecting head and the liquid storage unit, and connects with the first flow path in the liquid droplet ejecting head; a bypass flow path that is connected with the first flow path and the second flow path; a liquid feed unit that is provided between the liquid storage unit and a connecting portion of the bypass flow path and the first flow path, and that circulates the liquid in the liquid droplet ejecting head and the liquid storage unit; and a pressure control unit that is provided at the bypass flow path, and controls pressure of the liquid flowing through the bypass flow path from the first flow path side to the second flow path side.

BRIEF DESCRIPTION OF THE DRAWINGS

Exemplary embodiments of the present invention will be described in detail with reference to the following figures, wherein.

DETAILED DESCRIPTION

Figure 1:
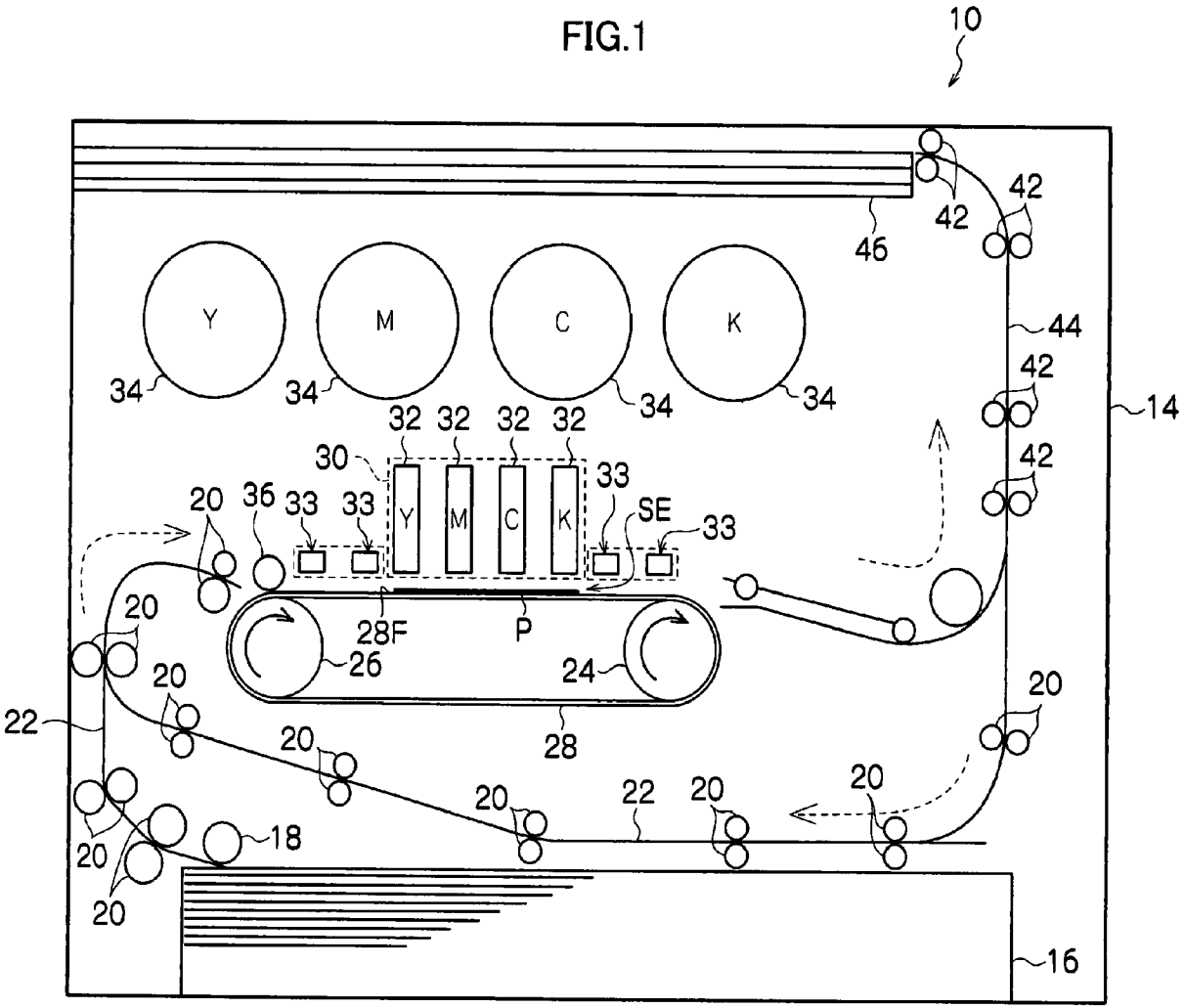
FIG. 1 is a schematic view showing an ink jet recording device according to a first exemplary embodiment of the invention.

First, an ink jet recording device 10 as a liquid droplet ejecting device according to a first exemplary embodiment of the present invention is explained below. FIG. 1 shows the ink jet recording device 10.

As shown in FIG. 1, on the bottom of a casing 14 of the ink jet recording device 10, a paper feed tray 16 is arranged, and paper sheets laminated and stored in the paper feed tray 16 are taken out one after another by a pickup roll 18. Paper sheets taken out are transferred by plural pairs of transfer rolls 20 that structure a specified transfer route 22.

Above the paper feed tray 16, an endless transfer belt 28 engaged in a tensioned condition across a driving roll 24 and a driven roll 26 is arranged. Above the transfer belt 28, a recording head array 30 is arranged, and opposes the flat portion 28F of the transfer belt 28. This opposing area is an eject area SE where ink droplets are ejected from the recording head array 30. The paper sheet transferred on the transfer route 22 is held by the transfer belt 28 and reaches this eject area SE, and in the state opposing the recording head array 30, ink droplets according to image information are applied from the recording head array 30 onto the paper sheet.

The recording head array 30 in the exemplary embodiment is so formed to be a long shape whose effective recording area is over the width (length in the direction perpendicular to the transfer direction) of the paper sheet, and ink jet recording heads (hereinafter, referred to as recording heads) 32 as four liquid droplet ejecting heads corresponding to four colors, that is, yellow (Y), magenta (M), cyan (C), and black (K) respectively are arranged along the transfer direction therein, and thereby full color images can be recorded.

The respective recording heads 32 are controlled by a head drive circuit (not shown). The head drive circuit is the structure that determines for example the eject timing of ink droplets and ink eject ports (nozzles) to be used according to image information, and sends drive signals to the recording heads 32.

Further, the recording heads 32 may be fixed in the direction perpendicular to the transfer direction, meanwhile, if it is so structured to move as needs arise, in image recording by multiple paths, higher resolution images can be recorded, and at a time of trouble with the recording heads 32, it can be prevented that the trouble affects on recording results.

Figure 2:
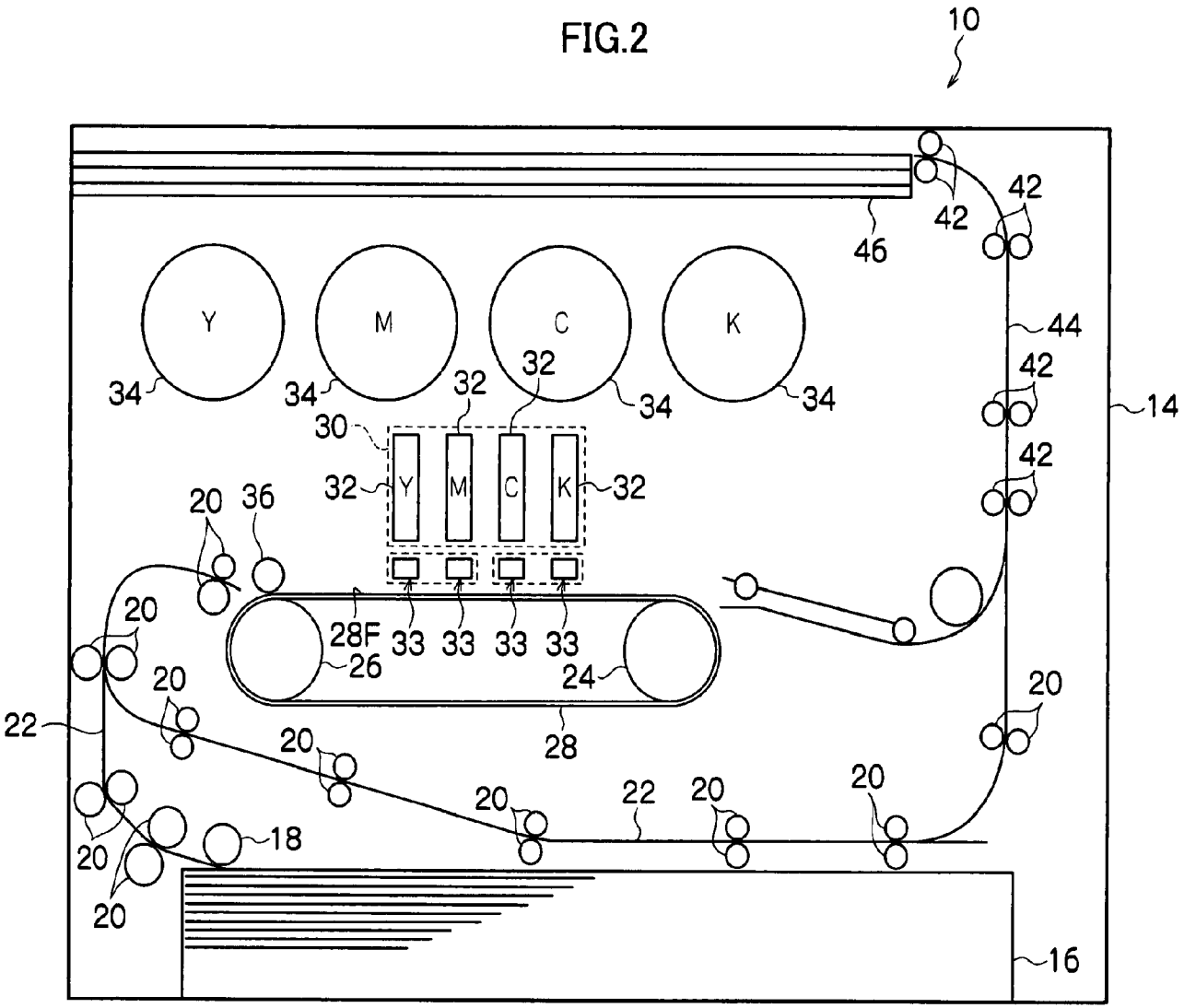
FIG. 2 is a schematic view showing an ink jet recording device according to a first exemplary embodiment of the invention.

At both the sides of the recording head array 30, four maintenance units corresponding to the respective recording heads 32 are arranged. As shown in FIG. 2, when the recording heads 32 are capped, the recording head array 30 is moved upward, and the maintenance units 33 are moved to and inserted into the clearance between the transfer belt 28 and the recording head array 30, and in the state where it oppositely faces a nozzle surface 32N (refer to FIG. 3), specified maintenance actions (absorbing, wiping, capping and the like) are performed.

Figure 3:
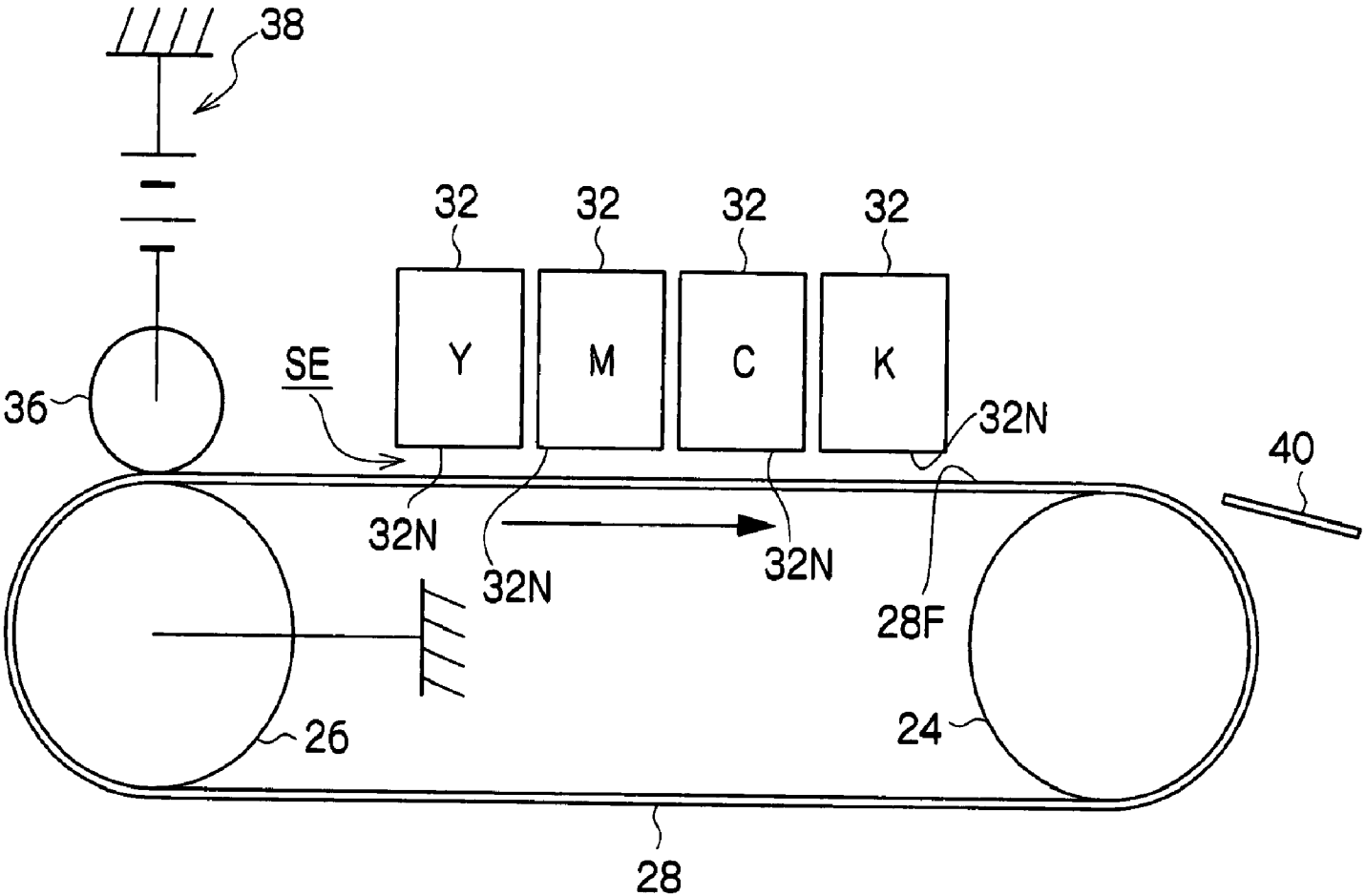
FIG. 3 is a schematic view showing the printing unit of an ink jet recording device according to a first exemplary embodiment of the invention.

As shown in FIG. 3, at the upstream side of the recording head array 30, a charge roll 36 to which a power source 38 is connected is arranged. The charge roll 36 pinches the transfer belt 28 and the paper sheet with the driven roll 26 and is driven, and moves between the press position at which it presses the paper sheet onto the transfer belt 28, and the away position at which it is away from the transfer belt 28. At the press position, since there generates a specified potential difference between the grounded driven roll 26, by giving electric charge to the paper sheet, the paper sheet can be electrostatically absorbed to the transfer belt 28.

At the downstream side of the recording head array 30, a peel-off plate 40 is arranged, which peels off the paper sheet from the transfer belt 28. The peeled paper sheet is transferred by plural pairs of paper discharge rolls 42 that structure a paper discharge route 44, and discharged to a paper discharge tray 46 arranged at the top of the casing 14.

Further, as shown in FIG. 1 and FIG. 2, above the recording head array 30, main tanks (ink tanks) 34 for storing ink in the respective colors are arranged.

Figure 4:
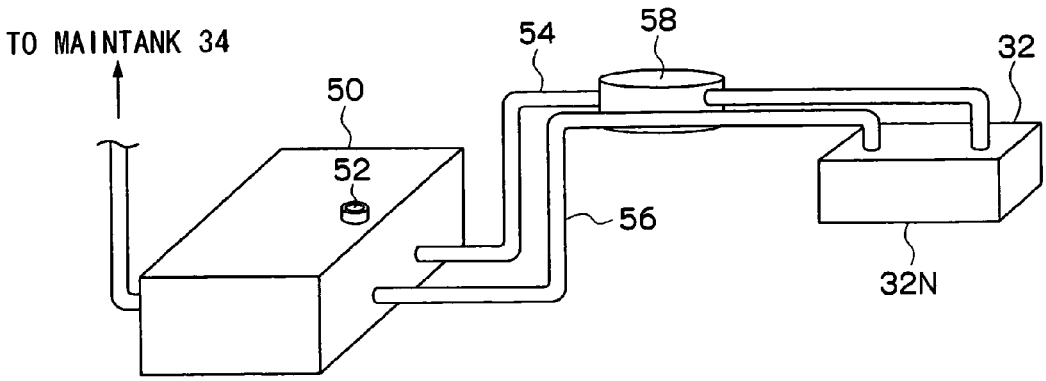
FIG. 4 is a schematic view showing the positional relation between a reservoir tank and ink jet recording heads to be installed in an ink jet recording device according to a first exemplary embodiment.

Between the main tanks 34 and the recording heads 32, as shown in FIG. 4, reservoir tanks 50 as a liquid storage unit are arranged. Into the reservoir tank 50, ink of the main tank 34 (refer to FIG. 1) is resupplied as needs arise, and stored therein. And, the ink stored in the reservoir tank 50 is resupplied to the recording head 32.

In the upper surface of the reservoir tank 50, an air release port 52 is arranged. The air release port 52 is always opened to the atmosphere, and the atmospheric pressure is working onto the liquid surface of the ink in the reservoir tank 50.

The reservoir tank 50 and the recording head 32 are connected with each other by a circulation outward route 54 and a circulation homeward route 56. Thereby, between the reservoir tank 50 and the recording head 32, the ink is circulated through the circulation outward route 54 and the circulation homeward route 56.

At the circulation outward route 54, a circulation pump 58 is arranged. In the exemplary embodiment, as the circulation pump 58, a tube pump is used that does not let the ink go through at non-action state (at the stop of the circulation pump). When this circulation pump 58 is driven, the ink flows through the circulation outward route 54 or the circulation homeward route 56 from the reservoir tank 50 to the recording head 32.

Meanwhile, in FIG. 4, an open/close valve 62 and a relief valve 64 arranged in a bypass route 60 and the bypass route 60 which will be described later herein are omitted.

Figure 5:
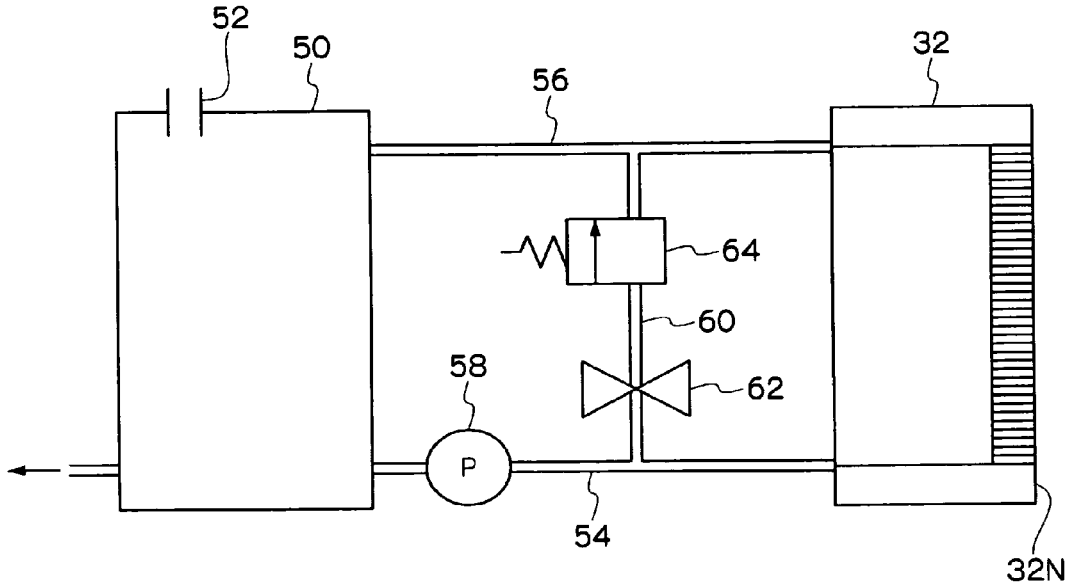
FIG. 5 is a schematic view showing a reservoir tank and ink jet recording heads of an ink jet recording device according to a first exemplary embodiment.

FIG. 5 is a schematic diagram of the reservoir tank 50 and the recording head 32. For easy understanding, in FIG. 5 and thereafter, explanations are made by use of the schematic diagram of the reservoir tank 50 and the recording head 32.

The circulation outward route 54 and the circulation homeward route 56 are connected with each other by the bypass route 60. The bypass route 60 is connected to the circulation outward route 54 at the side of the recording head 32 with respect to the position where the circulation pump 58 is provided, that is, bypass route 60 is connected to the circulation outward route 54 at a position between the recording head 32 and the circulation pump 58. Thereby, when the circulation pump 58 is driven such that the ink flows through the circulation outward route 54 from the reservoir tank 50 to the recording head 32, the ink flows into the recording head 32 and the bypass route 60.

In the bypass route 60, the open/close valve 62 is arranged. When the open/close valve 62 is opened, the ink that flows into the bypass route 60 flows into the circulation homeward route 56 through the relief valve 64 as a pressure control unit which will be described later herein.

Further, in the bypass route 60, the relief valve 64 is provided at the side of the circulation homeward route 56 with respect to the position where the open/close valve 62 is provided. The relief valve 64 is opened when the pressure of the ink flowing through the bypass route 60 becomes a specified value or higher. That is, when the pressure difference between front side and rear side of the relief valve 64 (between the circulation outward route 54 side and the circulation homeward route 56 side) becomes a specified value or higher, the relief valve 64 is opened.

Thereby, when the open/close valve 62 is opened and the circulation pump 58 is driven such that the ink flows through the circulation outward route 54 from the reservoir tank 50 to the recording head 32, if the pressure of the ink that flows into the bypass route 60 is the specified value or higher, the relief valve 64 opens, and the ink flows from the bypass route 60 into the circulation homeward route 56.

Accordingly, when the circulation pump 58 is driven in the state where the open/close valve 62 is opened and the ink is flown from the reservoir tank 50 toward the recording head 32, even though the pressure of the ink fluctuates, the relief valve 64 opens to make the increased pressure released, thereby the pressure of the ink flowing into the recording head 32 becomes constant.

Figure 20:
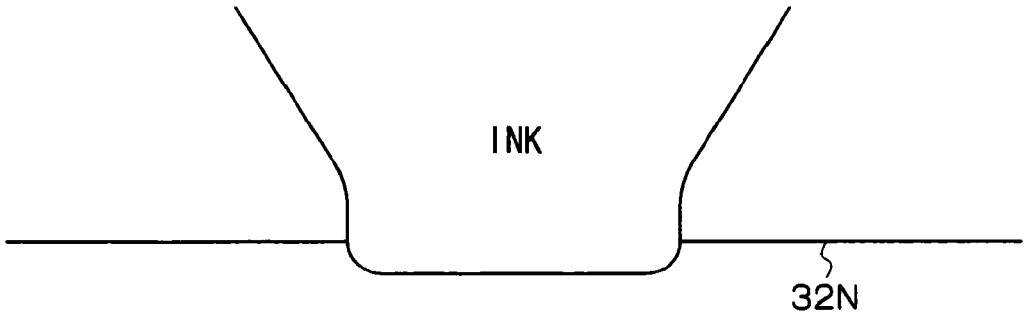
FIG. 20 is a cross sectional enlarged view showing an example of a state where an ink is swelled from a nozzle according to exemplary embodiments of the invention.

That is, when the relief (open) pressure of the relief valve 64 is set at the pressure at which the ink swells from the nozzles and meniscus is formed, even though the ink is circulated excessively by the drive of the circulation pump 58, there is no fear that the meniscus is broken and the ink flows out from the nozzle. FIG. 20 shows an example of a state where the ink is swelled from the nozzle.

For example, when the relief (open) value of the relief valve 64 is set to P, the relief value P is so set that the following expression is established:

$$0<P<\text{meniscus destruction pressure}$$

wherein, P=0 shows a state where the ink does not swell at the nozzle surface 32N, and the ink meniscus is positioned on the same level of the nozzle surface 32N.

Meanwhile, in the exemplary embodiment, a recording head 32 whose meniscus destruction pressure is 40 $mmH_2O$ is used. Accordingly, the relief value P (pressure P) of the relief valve 64 is set so that $0<P<40$ $mmH_2O$.

Meanwhile, when the pressure P is so set that $0<P\leqq 10$ $mmH_2O$, the swell amount of the ink from the nozzles is too small for carrying out wiping, and there is a fear that the nozzle surface 32N may be damaged. Further, when the pressure P is so set that $30\leqq P<40$ $mmH_2O$, the possibility occurrence of meniscus destruction increases due to external disturbance such as environmental changes and the like. Therefore, it is desirable to set the pressure P so that $10<P<30$ $mmH_2O$. Thereby, the ink swells at the nozzle surface 32N, and the meniscus is not destructed.

Herein, actions of the ink jet recording device 10 at ink ejecting (at printing), at ink swell at maintenance and at ink circulation are explained.

Figure 6A:
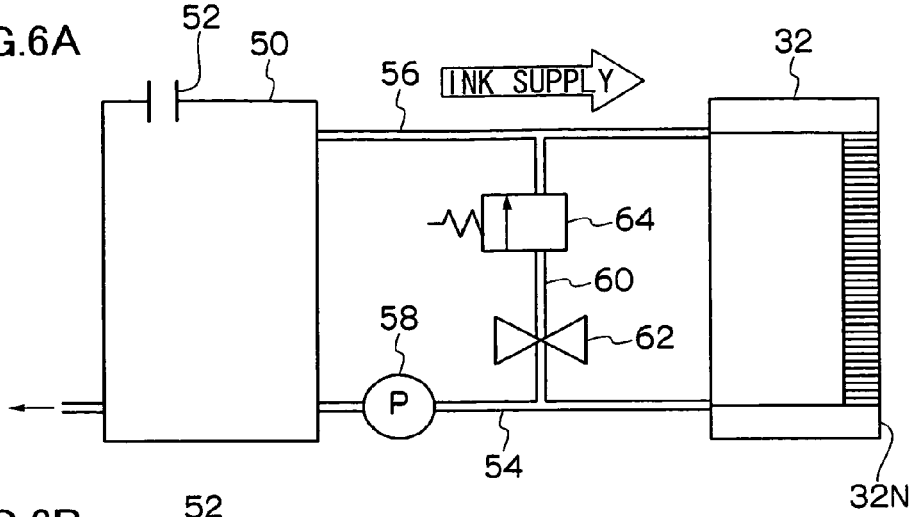
FIG. 6A is a schematic view showing a reservoir tank and ink jet recording heads of an ink jet recording device according to a first exemplary embodiment.

FIG. 6(A) shows the action of the ink jet recording device 10 at the time of ink ejecting. At the ink ejecting, the open/close valve 62 is closed. And, when the ink is ejected from the nozzles of the recording head 32, the pressure inside of the recording head 32 becomes negative, and the ink flows through the circulation homeward route 56, from the reservoir tank 50 to the recording head 32.

Figure 6B:
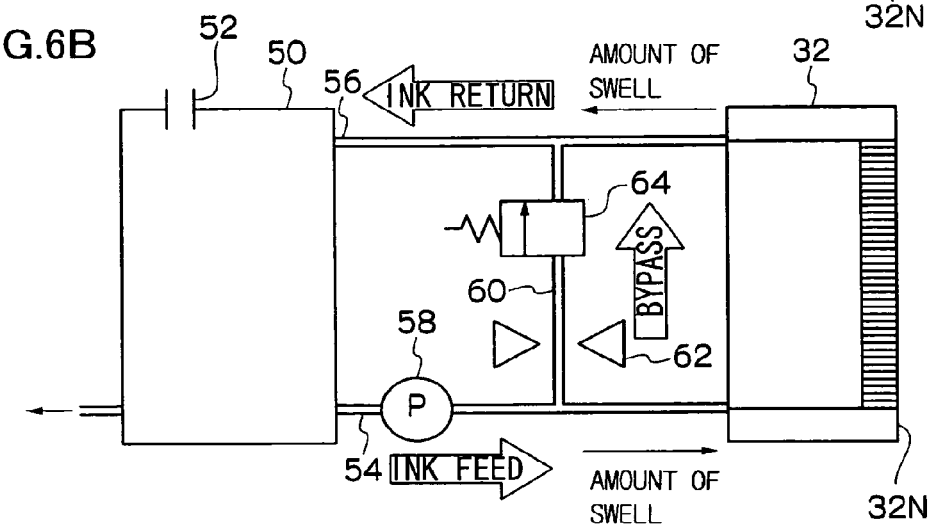
FIG. 6B is a schematic view showing a reservoir tank and ink jet recording heads of an ink jet recording device according to a first exemplary embodiment.

FIG. 6(B) shows the action of the ink jet recording device 10 at the time of so-called ink swell where the ink is swelled at the nozzle surface 32N at maintenance. At the ink swell, the open/close valve 62 is opened. And, the circulation pump 58 is driven such that the ink flows through the circulation outward route 54, from the reservoir tank 50 to the recording head 32. The circulation pump 58 is driven so as to generate pressure of the ink which pressure causes the ink to be swelled from the nozzle by the ink flowing into the recording head 32.

At this moment, if the pressure of the ink flowing into the recording head 32 is the relief value or higher of the relief valve 64, the relief valve 64 is opened, and the ink flows from the bypass route 60 into the circulation homeward route 56.

Thereby, the pressure of the ink flowing into the recording head 32 is kept at a specified value (value that does not destruct the meniscus formed on the nozzle surface), and accordingly, even if the ink swells from the nozzles, there is no fear that the meniscus is destructed and the ink flows out.

Figure 6C:
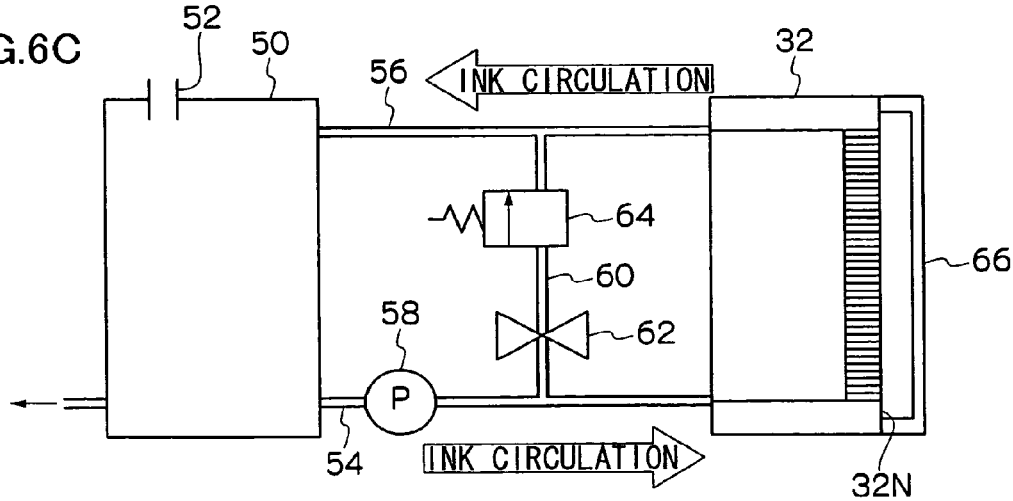
FIG. 6C is a schematic view showing a reservoir tank and ink jet recording heads of an ink jet recording device according to a first exemplary embodiment.

FIG. 6(C) shows the action of the ink jet recording device 10 at the time of ink circulation. When the ink is to be circulated between the reservoir tank 50 and the recording head 32, the open/close valve 62 is closed, and a cap member 66 is closely attached to the nozzle surface 32N of the recording head 32.

Then, the circulation pump 58 is driven so that the ink flows through the circulation outward route 54, from the reservoir tank 50 toward the recording head 32.

Thereby, the ink flows through the circulation outward route 54 from the reservoir tank 50 into the recording head 32, and the ink flows through the circulation homeward route 56 from the recording head 32 into the reservoir tank 50, and the ink is circulated between the reservoir tank 50 and the recording head 32. At this moment, air bubbles generated in the recording head 32 are sent into the reservoir tank 50, and discharged to the atmosphere through the air release port 52.

Next, the actions of the ink jet recording device 10 according to the first exemplary embodiment is explained below.

As shown in FIG. 1, when an image is formed, the maintenance units 33 move to both sides of the recording head array 30, and the recording head array 30 comes close to the transfer belt 28.

Paper sheets are taken out one after another from the paper feed tray 16 by the pickup roll 18, and fed to the pairs of transfer rolls 20. Then, the paper sheet is transferred through the transfer route 22 to the ejecting area SE. And, inks of Y, M, C, and K are ejected from the respective recording heads 32 onto the paper sheet, and a full color image is recorded on the paper sheet.

The paper sheet on which the full color image is recorded is peeled off from the transfer belt 28 by the peel-off plate 40 (refer to FIG. 3), and transferred to the paper discharge route 44. The paper sheet transferred to the paper discharge route 44 is transferred by the pairs of paper discharge rolls 42 toward the paper discharge tray 46.

Meanwhile, after a specified time elapses from recording the image, or after recording the images onto a specified number of paper sheets, a control computer (not shown) that controls the entire ink jet recording device 10 outputs a wiping command so as to remove the ink attaching to the nozzle surface 32N.

Figure 7A:
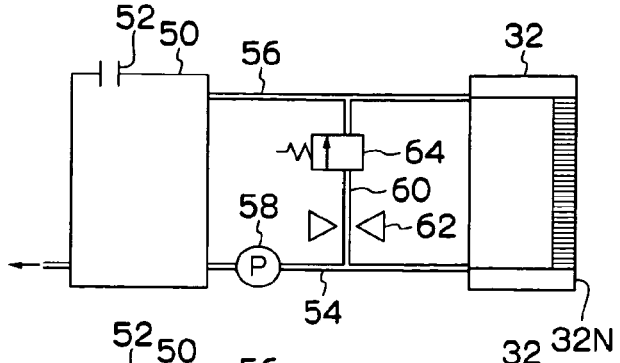
FIG. 7A is a schematic view showing a reservoir tank and ink jet recording heads of an ink jet recording device according to a first exemplary embodiment.
Figure 7B:
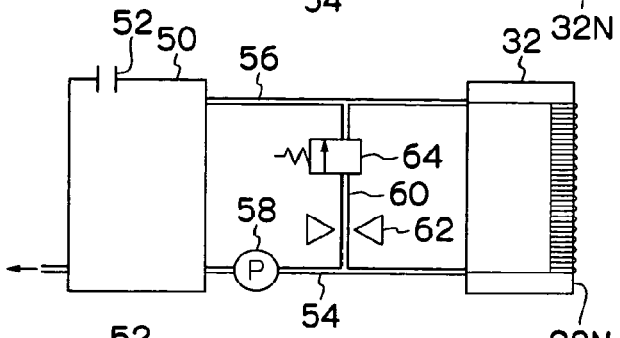
FIG. 7B is a schematic view showing a reservoir tank and ink jet recording heads of an ink jet recording device according to a first exemplary embodiment.
Figure 7C:
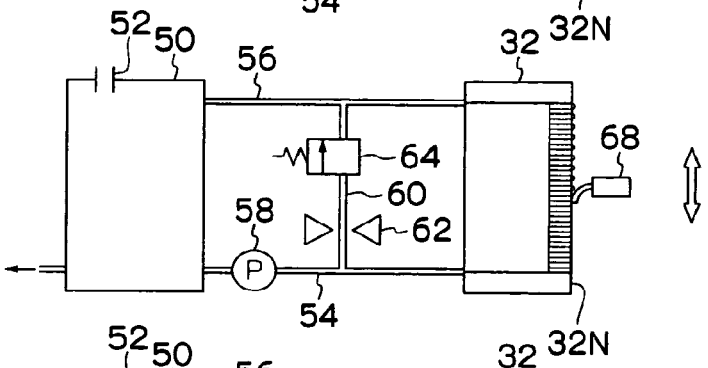
FIG. 7C is a schematic view showing a reservoir tank and ink jet recording heads of an ink jet recording device according to a first exemplary embodiment.
Figure 7D:
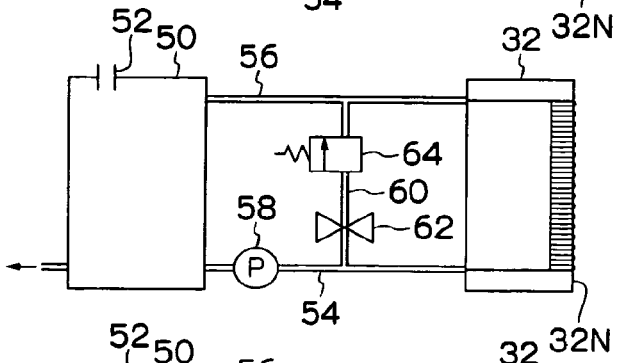
FIG. 7D is a schematic view showing a reservoir tank and ink jet recording heads of an ink jet recording device according to a first exemplary embodiment.
Figure 7E:
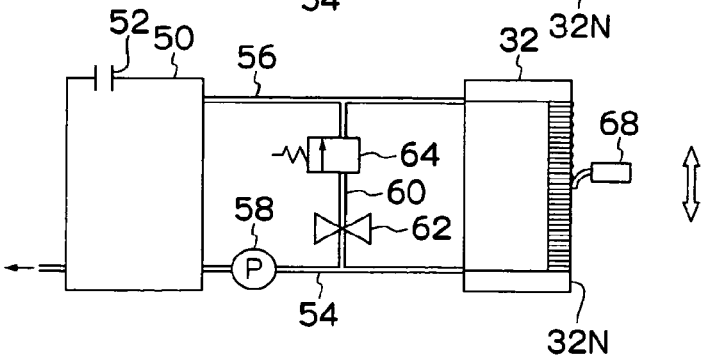
FIG. 7E is a schematic view showing a reservoir tank and ink jet recording heads of an ink jet recording device according to a first exemplary embodiment.
Figure 8:
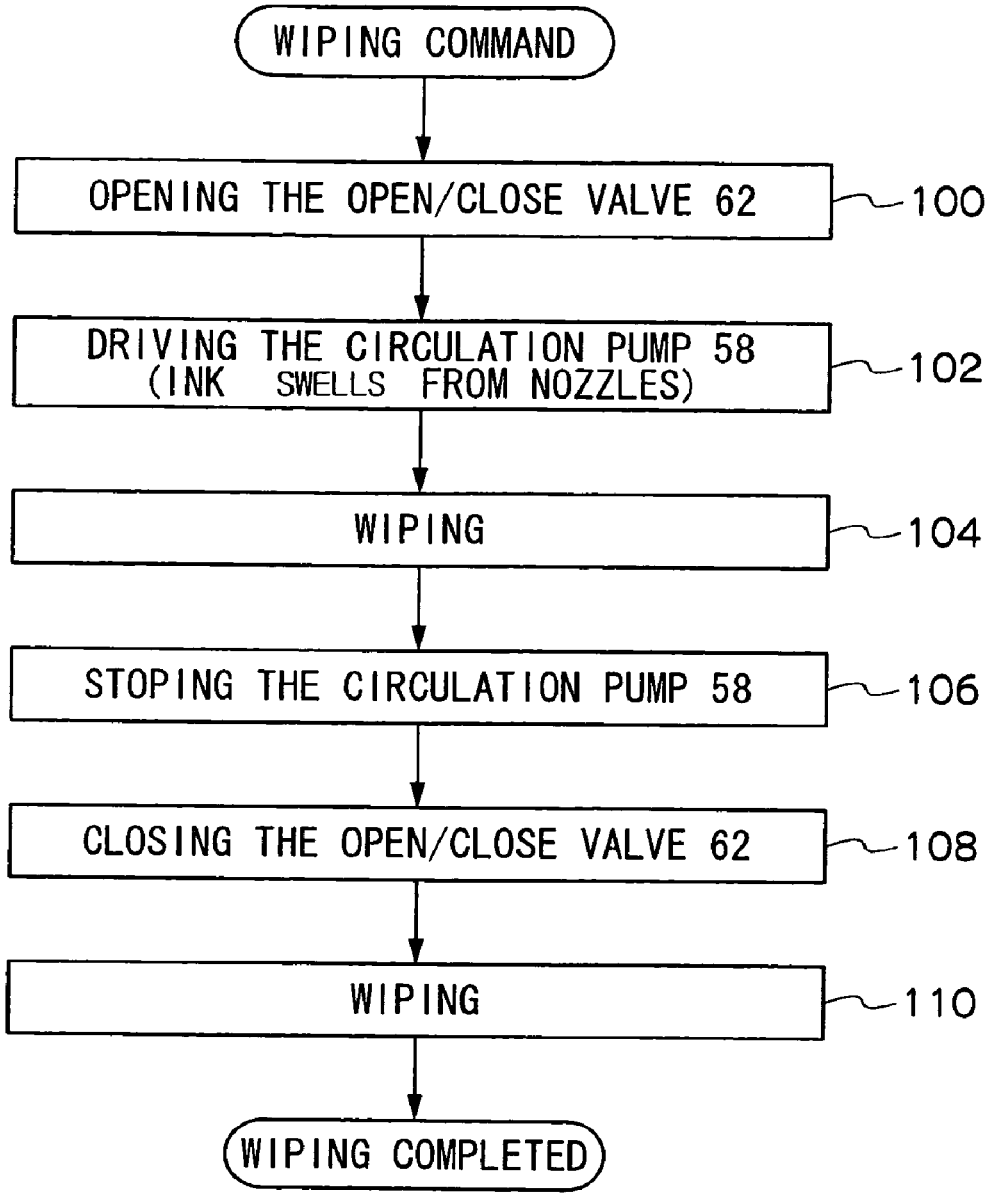
FIG. 8 is a flowchart showing the action of an ink jet recording device according to a first exemplary embodiment.

When the wiping command is output, the wiping action is performed according to the actions shown in the flowchart in FIG. 8. The outline of this wiping action is shown in FIG. 7.

At step 100 in FIG. 8, as shown in FIG. 7(A), the open/close valve 62 is opened. Then, at the next step 102, the circulation pump 58 is driven. Thereby, the ink flows from the reservoir tank 50 into the circulation outward route 54.

The ink flowing from the reservoir tank 50 into the circulation outward route 54 also flows into the bypass route 60. At this moment, if the pressure of the ink that flows into the recording head 32 is the relief value or higher of the relief valve 64, the relief valve 64 is opened, and the ink flows from the bypass route 60 into the circulation homeward route 56.

When the ink flows into the recording head 32, as shown in FIG. 7(B), the ink swells from the nozzles, and a convex shaped meniscus is formed on the nozzle surface 32N.

Then, at the next step 104, as shown in FIG. 7(C), a blade 68 moves reciprocating in the arrow direction and wipes the nozzle surface 32N. In this manner, the ink is swelled from the nozzles before wiping, and thereby the nozzle surface 32N is not wiped in its dry state, and accordingly the nozzle surface 32N is to be hardly damaged.

When the wiping is completed, the process goes on to step 106, where the circulation pump 58 is stopped, and at the next step 108, the open/close valve 62 is closed. At this moment, as shown in FIG. 7(D), on the nozzle surface 32N, the ink may be left since it is not removed at the first wiping, or due to the pressure in the recording head 32, the ink may swell again from the nozzles.

Accordingly, at the next step 110, as shown in FIG. 7(E), the blade 68 is reciprocated again in the arrow direction, to wipe the nozzle surface 32N. Thereby, the ink is removed completely from the nozzle surface 32N.

In this manner, the fluctuation of the ink pressure due to the fluctuation of the driving force of the circulation pump 58 at the time in which the ink is swelled from the nozzle, and the excessive pressure being applied to the recording head 32 in the case of excessive circulation of the ink, can be controlled by the relief valve 64, and accordingly it is possible to keep constant the pressure of the ink flowing into the recording head 32.

Further, by means of the circulation pump 58 and the relief valve 64, the pressure of the ink flowing into the recording head 32 can be controlled, therefore in comparison with the conventional method where the reservoir tank 50 is moved in a vertical direction, and thereby the difference in water heights of the reservoir tank 50 and the recording head 32 is changed, and thereby the pressure applied at the recording head 32 is controlled, it does not require a complicated structure such as a mechanism for moving the reservoir tank 50 upward and downward and the like. Thereby, the entire ink jet recording device 10 can be made compact, and low costs can be attained.

Meanwhile, in the exemplary embodiment, explanations have been made with the structure where when the circulation pump 58 is driven, the ink flows through the circulation outward route 54 from the reservoir tank 50 toward the recording head 32, however, the circulation pump 58 may be driven so that the ink flows through the circulation homeward route 56 from the reservoir tank 50 toward the recording head 32. That is, because the open/close valve 62 is provided at the bypass route 60, the direction for circulating the ink is not limited.

Next, an ink jet recording device according to a second exemplary embodiment is explained below. Meanwhile, explanations about the same components as in the first exemplary embodiment are omitted.

Figure 9:
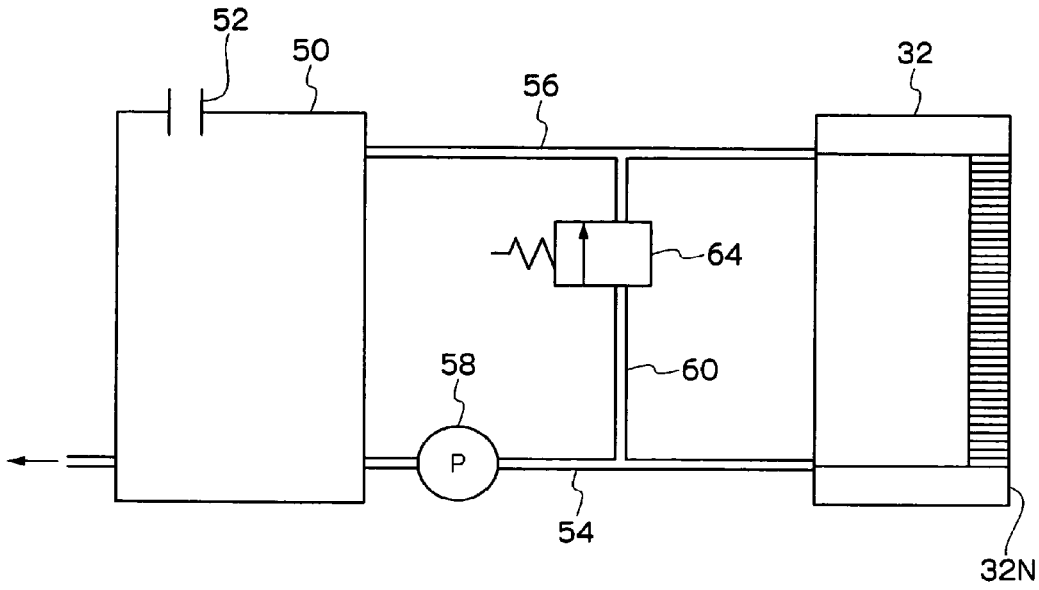
FIG. 9 is a schematic view showing a reservoir tank and ink jet recording heads of an ink jet recording device according to a second exemplary embodiment.

As shown in FIG. 9, at the bypass route 60 connecting the circulation outward route 54 and the circulation homeward route 56, only the relief valve 64 is provided.

Actions of the ink jet recording device according to the exemplary embodiment at ink ejecting, at ink swell at maintenance and at ink circulation are explained.

Figure 10A:
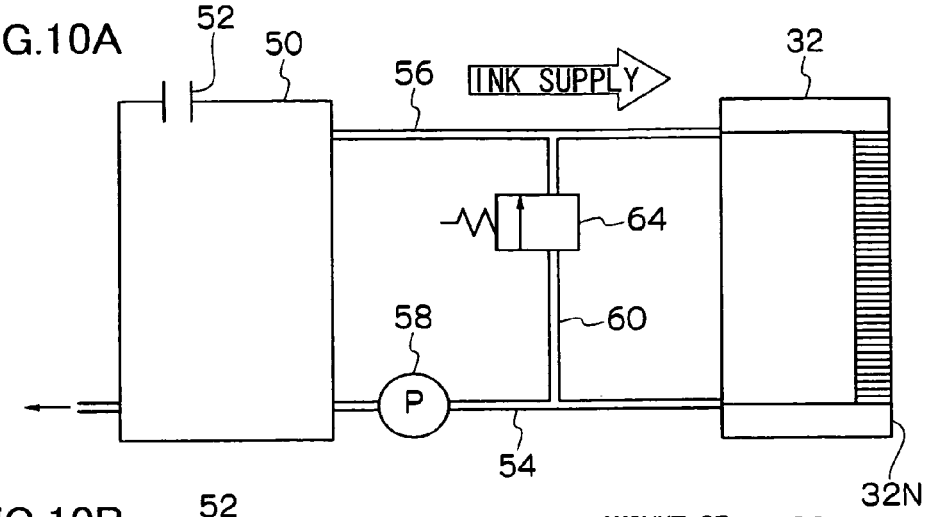
FIG. 10A is a schematic view showing a reservoir tank and ink jet recording heads of an ink jet recording device according to a second exemplary embodiment.

FIG. 10(A) shows the action of the ink jet recording device at the time of ink ejecting. At the ink ejecting, when the ink is ejected from the nozzles of the recording head 32, the pressure inside of the recording head 32 becomes negative, and the ink flows through the circulation homeward route 56, from the reservoir tank 50 to the recording head 32. Meanwhile, since the circulation pump 58 arranged at the circulation outward route 54 is not driven, the ink is not supplied through the circulation outward route 54 from the reservoir tank 50 to the recording head 32.

Figure 10B:
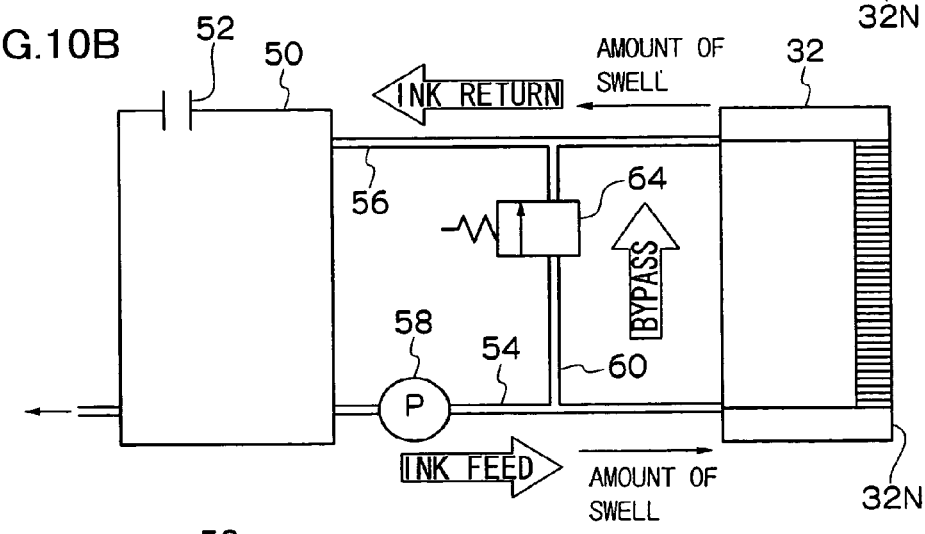
FIG. 10B is a schematic view showing a reservoir tank and ink jet recording heads of an ink jet recording device according to a second exemplary embodiment.

FIG. 10(B) shows the action of the ink jet recording device at the time of ink swell. The circulation pump 58 is driven such that the ink flows through the circulation outward route 54, from the reservoir tank 50 to the recording head 32.

At this moment, the ink flowing through the circulation outward route 54 flows also into the bypass route 60. If the pressure of the ink flowing into the recording head 32 is the relief value or higher of the relief valve 64, the relief valve 64 is opened, and the ink flows from the bypass route 60 into the circulation homeward route 56.

Thereby, the pressure of the ink flowing into the recording head 32 is kept at a specified value (value that does not destruct the meniscus formed on the nozzle surface), and accordingly, even though the ink swells from the nozzles, there is no fear that the meniscus is destructed and the ink flows out.

Figure 10C:
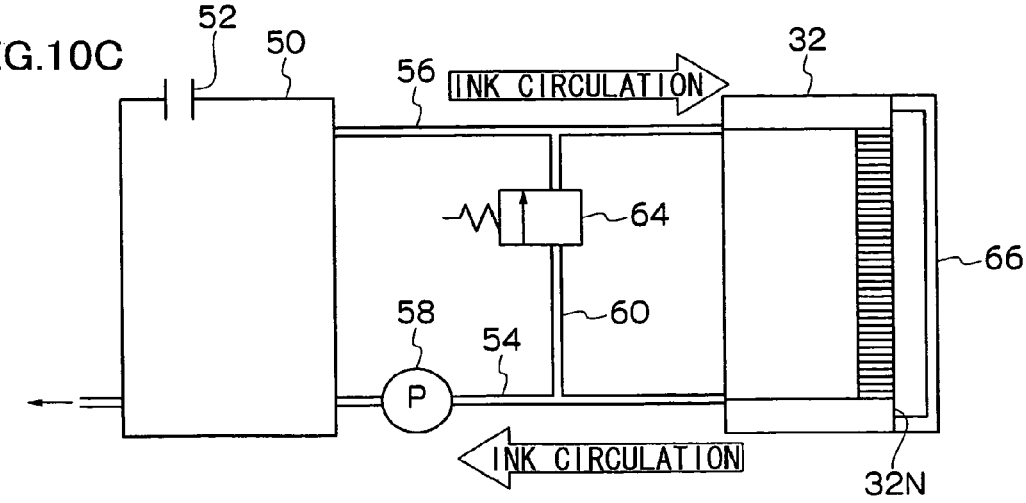
FIG. 10C is a schematic view showing a reservoir tank and ink jet recording heads of an ink jet recording device according to a second exemplary embodiment.

FIG. 10(C) shows the action of the ink jet recording device at the time of ink circulation. When the ink is to be circulated between the reservoir tank 50 and the recording head 32, the cap member 66 is closely attached to the nozzle surface 32N of the recording head 32. Then, the circulation pump 58 is driven so that the ink flows through the circulation homeward route 56, from the reservoir tank 50 toward the recording head 32. Thereby, the ink flows through the circulation homeward route 56 from the reservoir tank 50 into the recording head 32, and the ink flows through the circulation outward route 54 from the recording head 32 into the reservoir tank 50, and the ink is circulated between the reservoir tank 50 and the recording head 32.

Meanwhile, since the circulation pump 58 is provided at the side of the reservoir tank 50 with respect to the bypass route 60 of the circulation outward route 54, when the ink is circulated, there generates pressure in the direction from the bypass route 60 toward the circulation outward route 54. That is, an absorbing force is applied to the bypass route 60. Thereby, the pressure to always close the valve is applied to the relief valve 64, and accordingly, the ink will not flow from the circulation outward route 54 toward the bypass route 60.

As described above, when the circulation direction of the ink is changed between at the time of the ink swell and at the time of the ink circulation, there is no need to provide an open/close valve at the bypass route 60.

Next, an ink jet recording device according to a third exemplary embodiment is explained below. Meanwhile, explanations about the same components as in the first exemplary embodiment are omitted.

Figure 11:
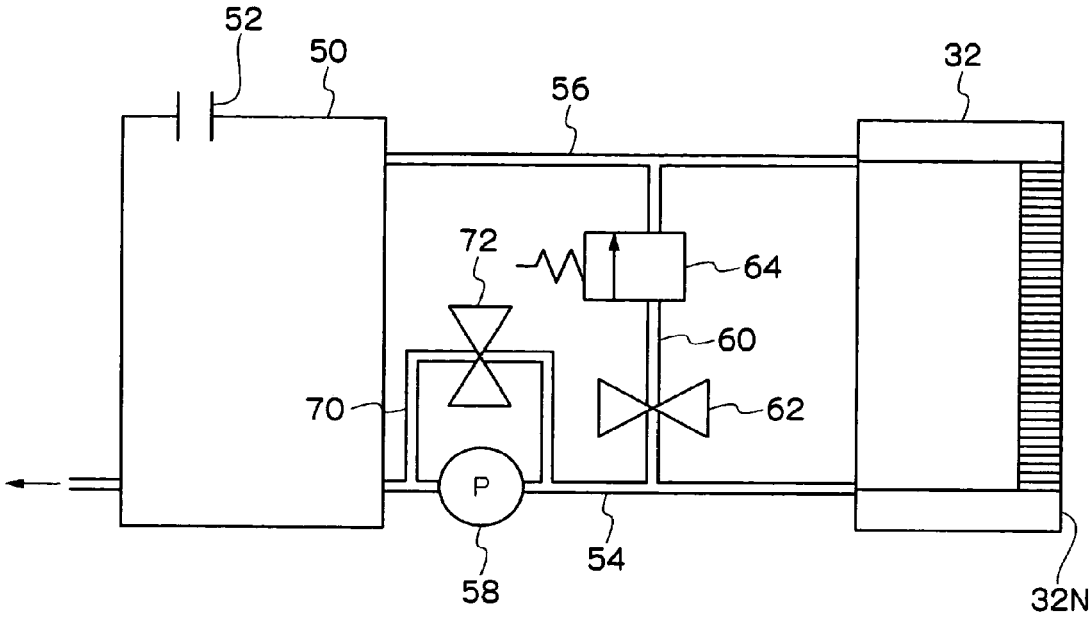
FIG. 11 is a schematic view showing a reservoir tank and ink jet recording heads of an ink jet recording device according to a third exemplary embodiment.

As shown in FIG. 11, at the circulation outward route 54, a bypass route 70 is provided so as to connect a portion between the reservoir tank 50 and the circulation pump 58 and a portion between the circulation pump 58 and the bypass route 60. That is, the bypass route 70 is arranged so as to stride over the circulation pump 58.

At this bypass route 70, a bypass valve 72 is provided, and when the bypass valve 72 is opened, the ink flows through the circulation outward route 54 via the bypass route 70.

Actions of the ink jet recording device according to the exemplary embodiment at ink ejecting, at ink swell at maintenance and at ink circulation are explained.

Figure 12A:
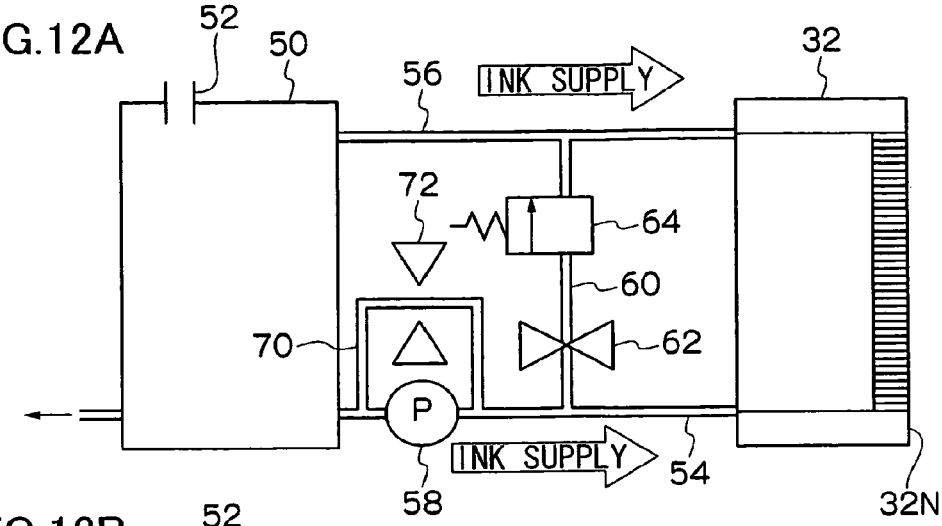
FIG. 12A is a schematic view showing a reservoir tank and ink jet recording heads of an ink jet recording device according to a third exemplary embodiment.

FIG. 12(A) shows the action of the ink jet recording device at the time of ink ejecting. At the ink ejecting, the bypass valve 72 is opened, and the open/close valve 62 is closed. And, when the ink is ejected from the nozzles of the recording head 32, the pressure inside of the recording head 32 becomes negative, and the ink flows through the circulation homeward route 56, from the reservoir tank 50 to the recording head 32. Further, through the bypass route 70, the ink in the reservoir tank 50 flows from the circulation outward route 54 into the recording head 32.

That is, when the ink is ejected from the recording head 32, the ink in the reservoir tank 50 can be supplied to the recording head 32, not only from the circulation homeward route 56 but also from the circulation outward route 54, and accordingly, the ink is unlikely to be out at the time of ink ejecting.

Figure 12B:
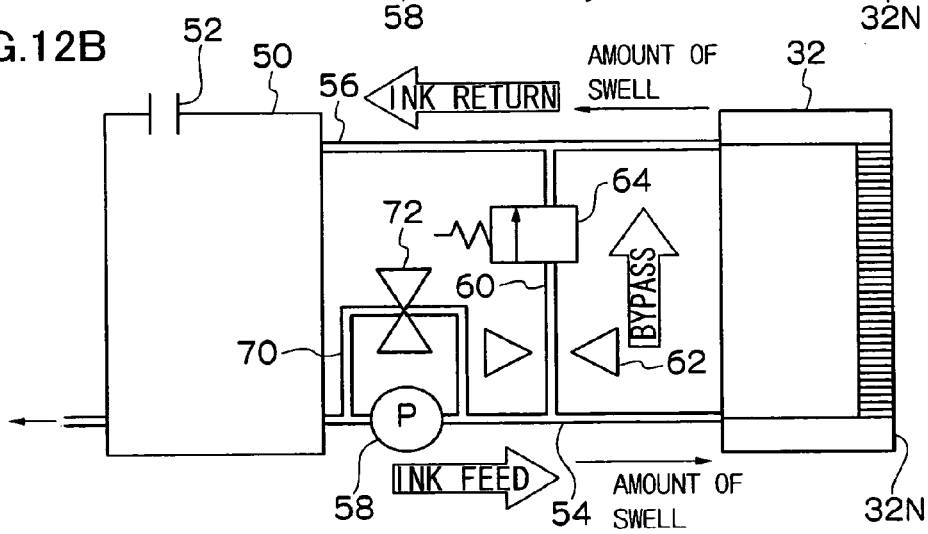
FIG. 12B is a schematic view showing a reservoir tank and ink jet recording heads of an ink jet recording device according to a third exemplary embodiment.

FIG. 12(B) shows the action of the ink jet recording device at the time of ink swell. At the ink swell, the open/close valve 62 is opened, and the bypass valve 72 is closed. And, the circulation pump 58 is driven such that the ink flows from the reservoir tank 50 to the recording head 32, through the circulation outward route 54.

At this moment, the ink flowing through the circulation outward route 54 flows also into the bypass route 60. If the pressure of the ink flowing into the recording head 32 is the relief value or higher of the relief valve 64, the relief valve 64 is opened, and the ink flows from the bypass route 60 into the circulation homeward route 56.

Thereby, the pressure of the ink flowing into the recording head 32 is kept at a specified value (value that does not destruct the meniscus formed on the nozzle surface), and accordingly, even if the ink swells from the nozzles, there is no fear that the meniscus is destructed and the ink flows out.

Figure 12C:
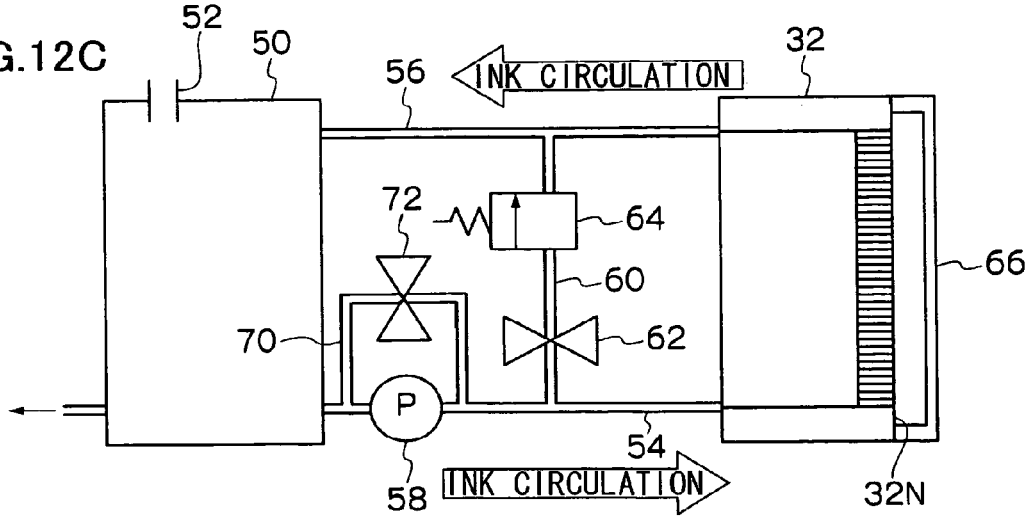
FIG. 12C is a schematic view showing a reservoir tank and ink jet recording heads of an ink jet recording device according to a third exemplary embodiment.

FIG. 12(C) shows the action of the ink jet recording device at the time of ink circulation. When the ink is to be circulated between the reservoir tank 50 and the recording head 32, the open/close valve 62 is closed and the bypass valve 72 is closed, and the cap member 66 is closely attached to the nozzle surface 32N of the recording head 32.

Then, the circulation pump 58 is driven so that the ink flows through the circulation outward route 54, from the reservoir tank 50 toward the recording head 32. Thereby, the ink flows through the circulation outward route 54 from the reservoir tank 50 into the recording head 32, and the ink flows through the circulation homeward route 56 from the recording head 32 into the reservoir tank 50, and the ink is circulated between the reservoir tank 50 and the recording head 32.

Next, an ink jet recording device according to a fourth exemplary embodiment is explained below. Meanwhile, explanations about the same components as in the first exemplary embodiment and the third exemplary embodiment are omitted.

Figure 13:
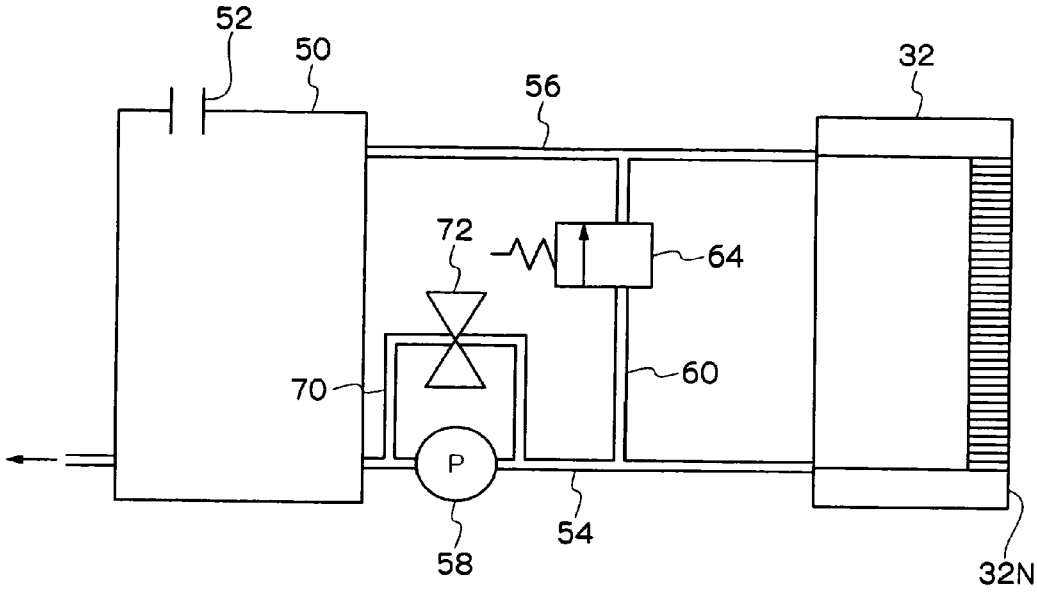
FIG. 13 is a schematic view showing a reservoir tank and ink jet recording heads of an ink jet recording device according to a fourth exemplary embodiment.

As shown in FIG. 13, at the bypass route 60 connecting circulation outward route 54 and the circulation homeward route 56, only the relief valve 64 is provided.

Actions of the ink jet recording device according to the exemplary embodiment at ink ejecting, at ink swell at maintenance and at ink circulation are explained.

Figure 14A:
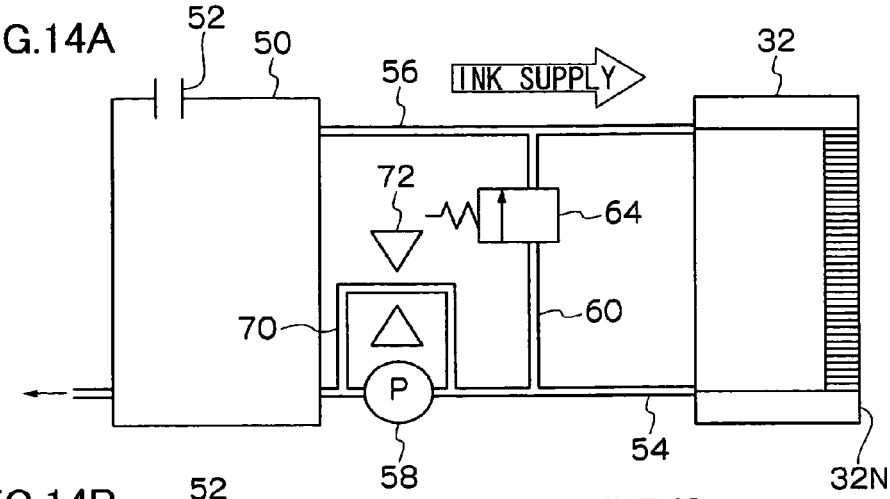
FIG. 14A is a schematic view showing a reservoir tank and ink jet recording heads of an ink jet recording device according to a fourth exemplary embodiment.

FIG. 14(A) shows the action of the ink jet recording device at the time of ink ejecting. At the ink ejecting, the bypass valve 72 is opened, and when the ink is ejected from the nozzles of the recording head 32, the pressure inside of the recording head 32 becomes negative, and the ink flows through the circulation homeward route 56, from the reservoir tank 50 to the recording head 32. Further, via the bypass route 70, the ink in the reservoir tank 50 flows from the circulation outward route 54 into the recording head 32.

Figure 14B:
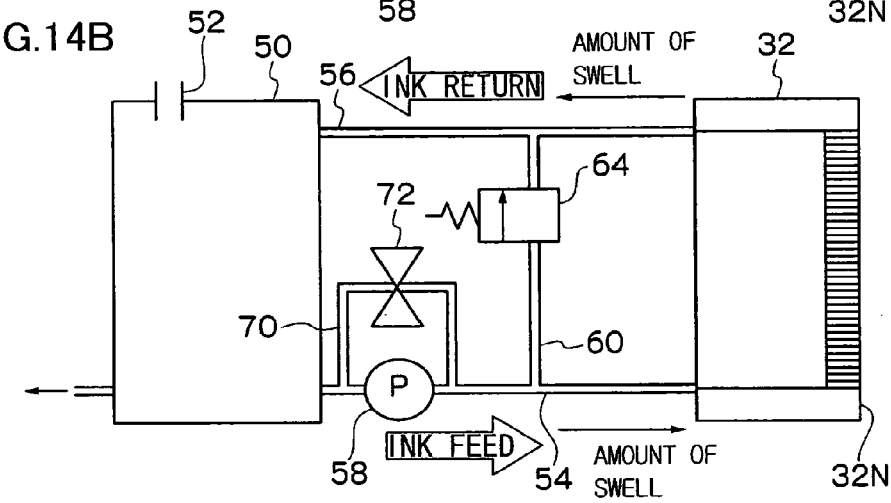
FIG. 14B is a schematic view showing a reservoir tank and ink jet recording heads of an ink jet recording device according to a fourth exemplary embodiment.

FIG. 14(B) shows the action of the ink jet recording device at the time of ink swell. The bypass valve 72 is closed and the circulation pump 58 is driven. Thereby, the circulation pump 58 is driven such that the ink flows through the circulation outward route 54, from the reservoir tank 50 to the recording head 32.

At this moment, the ink flowing through the circulation outward route 54 flows also into the bypass route 60. If the pressure of the ink flowing into the recording head 32 is the relief value or higher of the relief valve 64, the relief valve 64 is opened, and the ink flows from the bypass route 60 into the circulation homeward route 56.

Thereby, the pressure of the ink flowing into the recording head 32 is kept at a specified value (value that does not destruct the meniscus formed on the nozzle surface), and accordingly, even if the ink swells from the nozzles, there is no fear that the meniscus is destructed and the ink flows out.

Figure 14C:
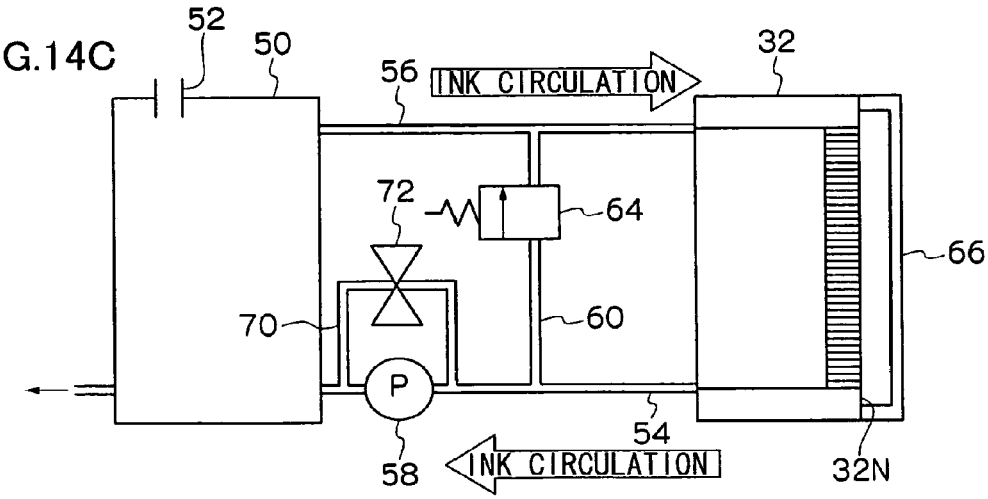
FIG. 14C is a schematic view showing a reservoir tank and ink jet recording heads of an ink jet recording device according to a fourth exemplary embodiment.

FIG. 14(C) shows the action of the ink jet recording device at the time of ink circulation. When the ink is to be circulated between the reservoir tank 50 and the recording head 32, the bypass valve 72 is closed, and the cap member 66 is closely attached to the nozzle surface 32N of the recording head 32.

Then, the circulation pump 58 is driven such that the ink flows through the circulation homeward route 56, from the reservoir tank 50 toward the recording head 32. Thereby, the ink flows through the circulation homeward route 56 from the reservoir tank 50 into the recording head 32, and the ink flows through the circulation outward route 54 from the recording head 32 into the reservoir tank 50, and the ink is circulated between the reservoir tank 50 and the recording head 32.

In the same manner as in the second exemplary embodiment, in the present structure, when the circulation direction of the ink is changed between at the time of the ink swell and at the time of the ink circulation, there is no need to provide an open/close valve at the bypass route 60.

Next, an ink jet recording device according to a fifth exemplary embodiment is explained below. Meanwhile, explanations about the same components as in the first exemplary embodiment are omitted.

Figure 15:
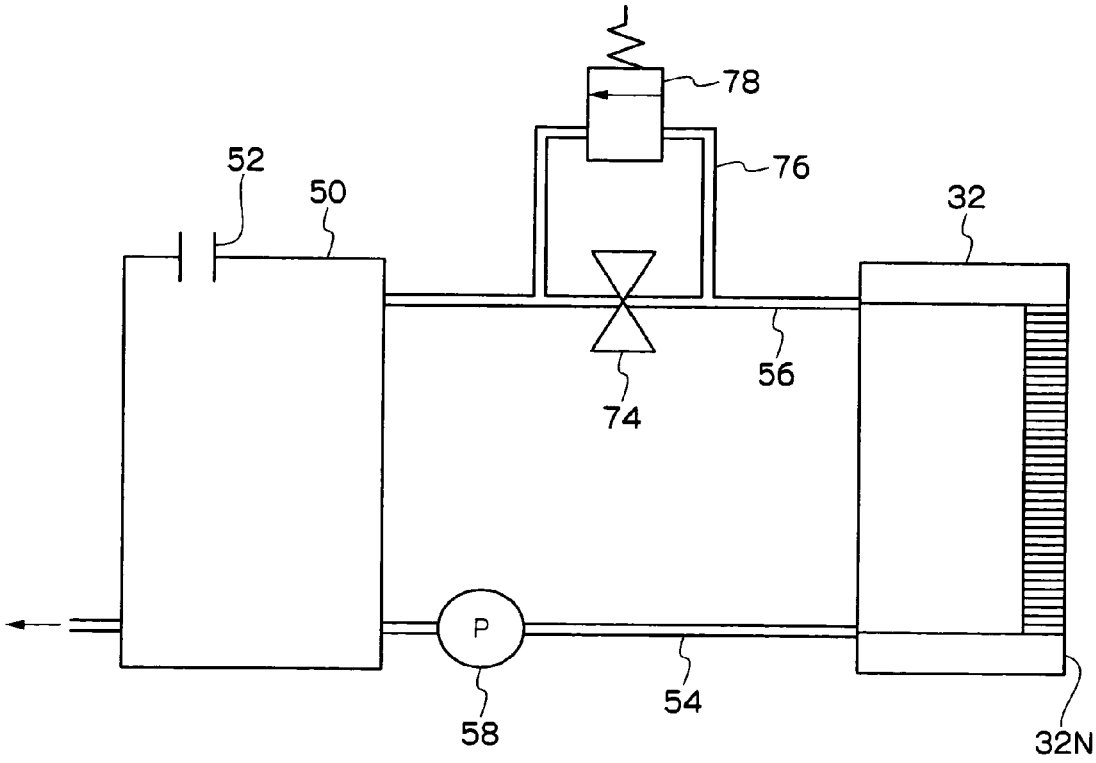
FIG. 15 is a schematic view showing a reservoir tank and ink jet recording heads of an ink jet recording device according to a fifth exemplary embodiment.

As shown in FIG. 15, at the circulation outward route 54 and the circulation homeward route 56, there is no bypass route provided to connect these, however an open/close valve 74 is provided at the circulation homeward route 56. Further, at the circulation homeward route 56, a bypass route 76 is provided so as to connect a portion between the reservoir tank 50 and the open/close valve 74, and a portion between the open/close valve 74 and the recording head 32. That is, the bypass route 76 is arranged so as to stride over the open/close valve 74.

At the bypass route 76, a relief valve 78 is provided. The relief valve 78 is opened when the pressure of the ink flowing through the bypass route 76 becomes a specified value or higher. That is, when the pressure difference between front side and rear side of the relief valve 78 (between the side of the recording head 32 and the side of the reservoir tank 50) becomes a specified value, the relief valve 78 is opened.

Actions of the ink jet recording device according to the exemplary embodiment at ink ejecting, at ink swell at maintenance and at ink circulation are explained.

Figure 16A:
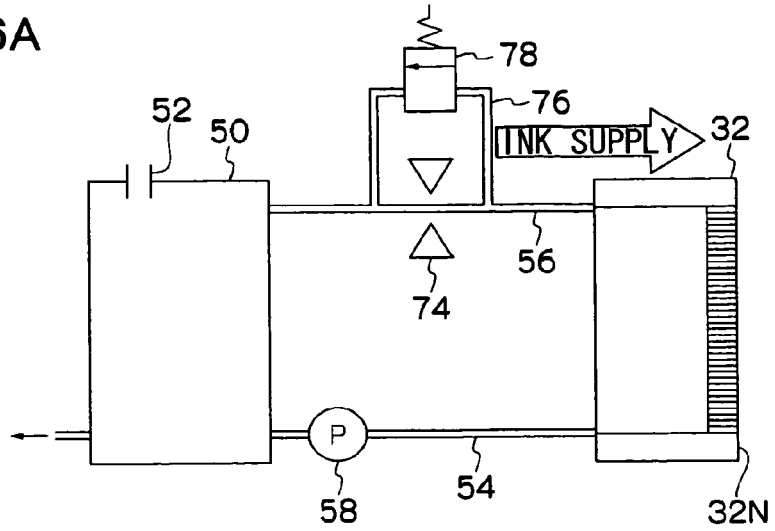
FIG. 16A is a schematic view showing a reservoir tank and ink jet recording heads of an ink jet recording device according to a fifth exemplary embodiment.

FIG. 16(A) shows the action of the ink jet recording device at the time of ink ejecting. At the ink ejecting, the open/close valve 74 is opened, and when the ink is ejected from the nozzles of the recording head 32, the pressure inside of the recording head 32 becomes negative, and the ink flows through the circulation homeward route 56, from the reservoir tank 50 to the recording head 32. Meanwhile, the circulation pump 58 arranged at the circulation outward route 54 is not driven, and accordingly, the ink is not supplied through the circulation outward route 54 from reservoir tank 50 to the recording head 32.

Figure 16B:
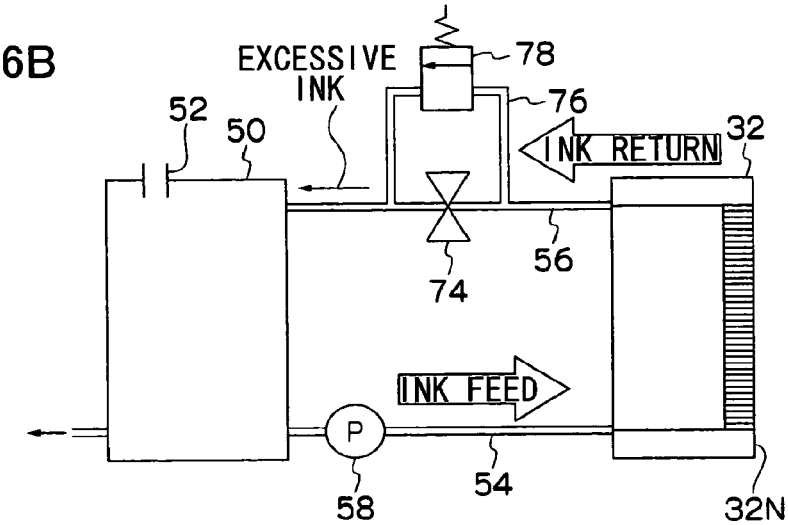
FIG. 16B is a schematic view showing a reservoir tank and ink jet recording heads of an ink jet recording device according to a fifth exemplary embodiment.

FIG. 16(B) shows the action of the ink jet recording device at the time of ink swell. At the ink swell, the open/close valve 74 is closed, and the circulation pump 58 is driven such that the ink flows through the circulation outward route 54 from the reservoir tank 50 toward the recording head 32. And, the ink flowing into the recording head 32 flows from the circulation homeward route 56 into the bypass route 76.

When the pressure of the ink flowing into the bypass route 76 is smaller than the relief value of the relief valve 78, the relief valve 78 is not opened, and the ink does not flow through the circulation homeward route 56. That is, the ink flowing into the recording head 32 is blocked state at the circulation homeward route 56. And, when the ink flows further into the recording head 32, the pressure of the ink flowing into the circulation homeward route 56 increases, and the pressure of the ink flowing into the bypass route 76 becomes the relief value of the relief valve 78 or higher. Thereby, the relief valve 78 is opened, and the ink flows through the circulation homeward route 56 and the bypass route 76 from the recording head 32 toward the reservoir tank 50.

Figure 16C:
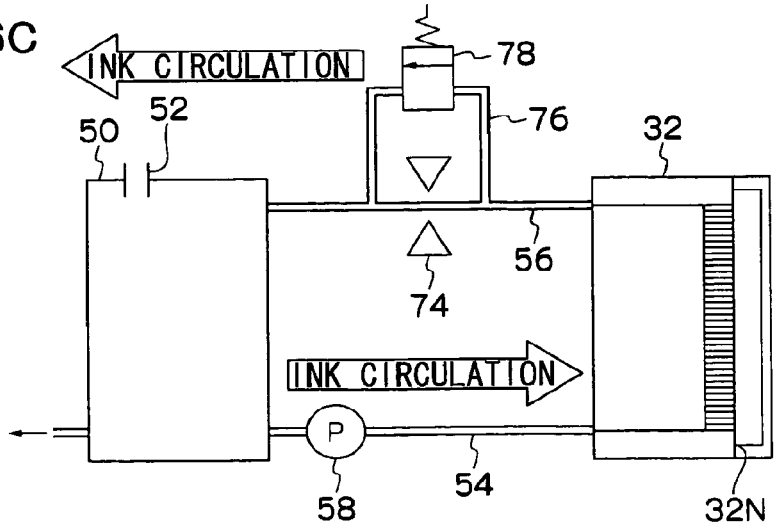
FIG. 16C is a schematic view showing a reservoir tank and ink jet recording heads of an ink jet recording device according to a fifth exemplary embodiment.

FIG. 16(C) shows the action of the ink jet recording device at the time of ink circulation. When the ink is to be circulated between the reservoir tank 50 and the recording head 32, the open/close valve 74 opened, and the cap member 66 is closely attached to the nozzle surface 32N of the recording head 32.

Then, the circulation pump 58 is driven such that the ink flows through the circulation outward route 54, from the reservoir tank 50 toward the recording head 32. Thereby, the ink flows through the circulation outward route 54 from the reservoir tank 50 into the recording head 32, and the ink flows through the circulation homeward route 56 from the recording head 32 into the reservoir tank 50, and the ink is circulated between the reservoir tank 50 and the recording head 32.

By circulating the ink between the reservoir tank 50 and the recording head 32 in this manner, air bubbles generated in the recording head 32 are sent into the reservoir tank 50, and discharged to the atmosphere through the air release port 52.

Next, an ink jet recording device according to a sixth exemplary embodiment is explained below. Meanwhile, explanations about the same components as in the first exemplary embodiment and the third exemplary embodiment are omitted.

Figure 17:
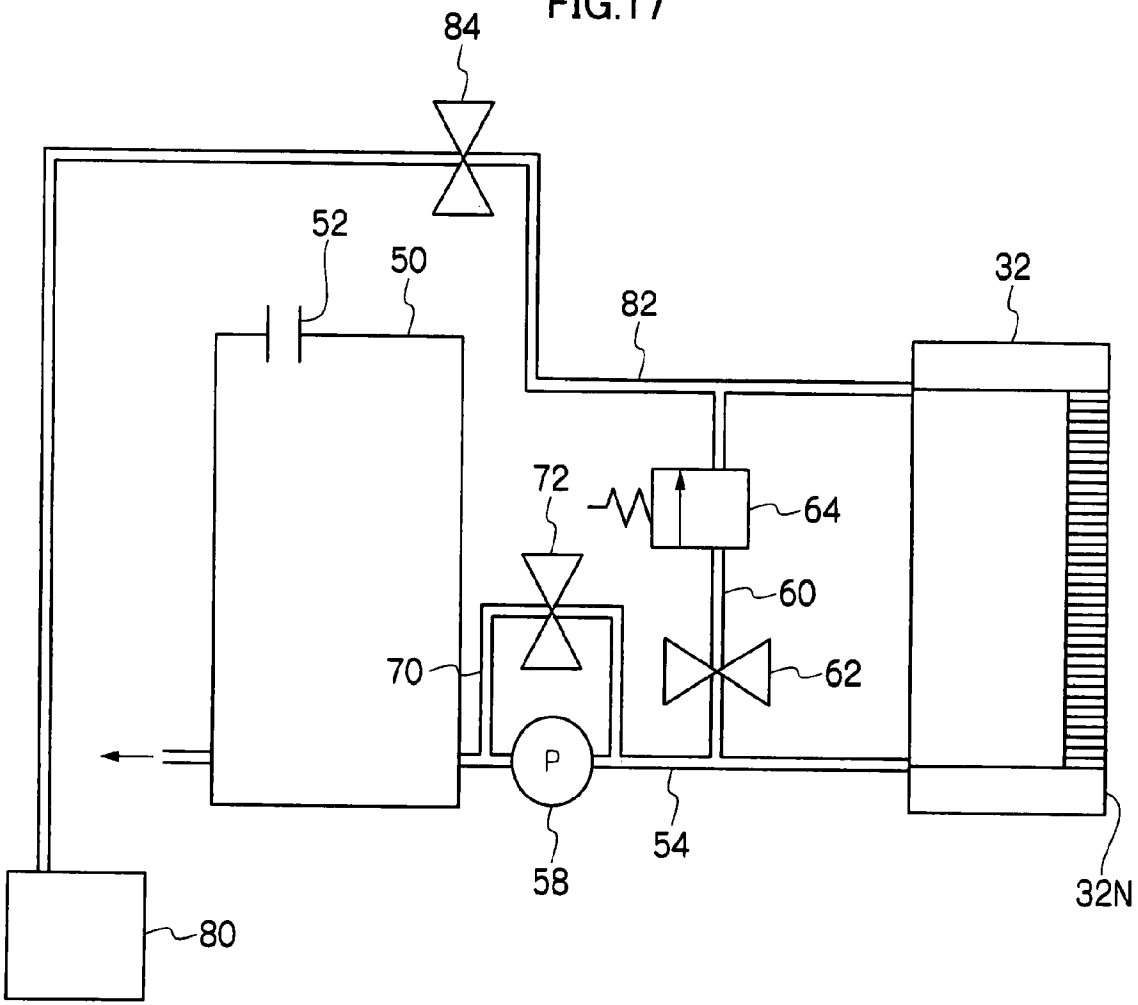
FIG. 17 is a schematic view showing a reservoir tank and ink jet recording heads of an ink jet recording device according to a sixth exemplary embodiment.

As shown in FIG. 17, the reservoir tank 50 and the recording head 32 are connected by the circulation outward route 54. At the circulation outward route 54, a circulation pump 58 is arranged, and when the circulation pump 58 is driven, the ink flows through the circulation outward route 54 from the reservoir tank 50 into the recording head 32.

Further, the recording head 32 is connected with a waste ink tank 80 by a circulation homeward route 82. At the circulation homeward route 82, an open/close valve 84 is provided, and when the open/close valve 84 is opened, the ink supplied from the reservoir tank 50 to the recording head 32 flows through the circulation homeward route 82 into the waste ink tank 80.

That is, since the ink is not circulated between the reservoir tank 50 and the recording head 32, even if impurities get inside of the recording head 32 at the time of ink ejecting, the ink flows into the waste ink tank 80 and is disposed, and it is not returned to the reservoir tank 50. Thereby, the ink in the reservoir tank 50 is always kept clean, and impurities do not get into the recording head 32.

The circulation outward route 54 and the circulation homeward route 82 are connected by the bypass route 60. The bypass route 60 is connected, at the side of the recording head 32, to the circulation outward route 54 with respect to a position where the circulation pump 58 of the circulation outward route 54 is provided. Thereby, when the circulation pump 58 is driven such that the ink flows through the circulation outward route 54 from the reservoir tank 50 toward the recording head 32, the ink flows into the recording head 32 and the bypass route 60.

At the bypass route 60, the open/close valve 62 is provided. When the open/close valve 62 is opened, the ink flowing into the bypass route 60 flows through the relief valve 64 into the circulation homeward route 82.

Thereby, when the open/close valve 62 is opened, and the circulation pump 58 is driven so that the ink flows through the circulation outward route 54 from the reservoir tank 50 toward the recording head 32, if the pressure of the ink flowing into the bypass route 60 is a specified value or higher, the relief valve 64 opens, and the ink flows from the bypass route 60 into the circulation homeward route 82.

Accordingly, when the circulation pump 58 is driven in the state where the open/close valve 62 is opened, and the ink is flown from the reservoir tank 50 toward the recording head 32, even if the ink pressure fluctuates, the relief valve 64 opens to make the increased pressure released, and accordingly, the pressure of the ink flowing into the recording head 32 becomes constant.

Further, at the circulation outward route 54, a bypass route 70 is provided so as to connect a portion between the reservoir tank 50 and the circulation pump 58, and a portion between the circulation pump 58 and the bypass route 60. That is, the bypass route 70 is arranged so as to stride over the circulation pump 58.

At this bypass route 70, a bypass valve 72 is provided, and when the bypass valve 72 is opened, the ink flows through the circulation outward route 54 via the bypass route 70.

Actions of the ink jet recording device according to the exemplary embodiment at ink ejecting, at ink swell at maintenance and at ink feeding are explained.

Figure 18A:
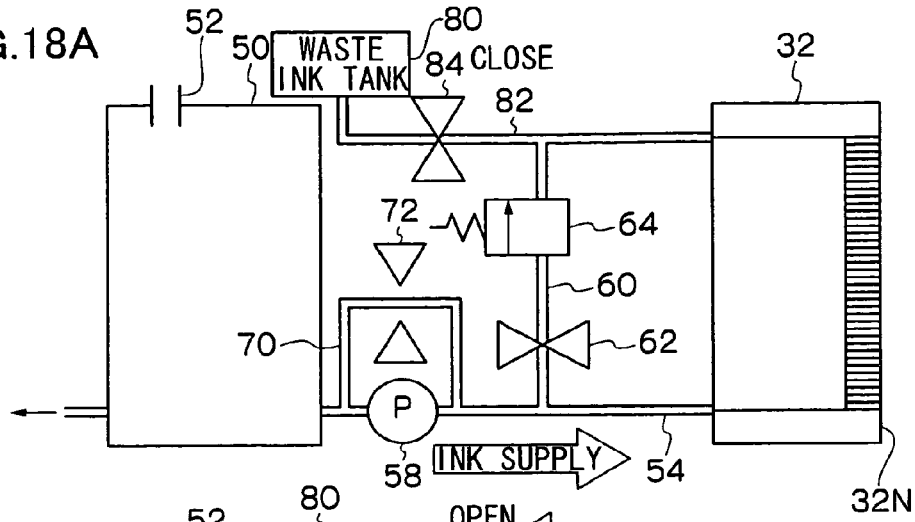
FIG. 18A is a schematic view showing a reservoir tank and ink jet recording heads of an ink jet recording device according to a sixth exemplary embodiment.

FIG. 18(A) shows the action of the ink jet recording device at the time of ink ejecting. At the ink ejecting, the bypass valve 72 is opened, and the open/close valve 62 and the open/close valve 84 are closed. And, when the ink is ejected from the nozzles of the recording head 32, the pressure inside of the recording head 32 becomes negative, and the ink in the reservoir tank 50 flows through bypass route 70 from the circulation homeward route 54 to the recording head 32.

Figure 18B:
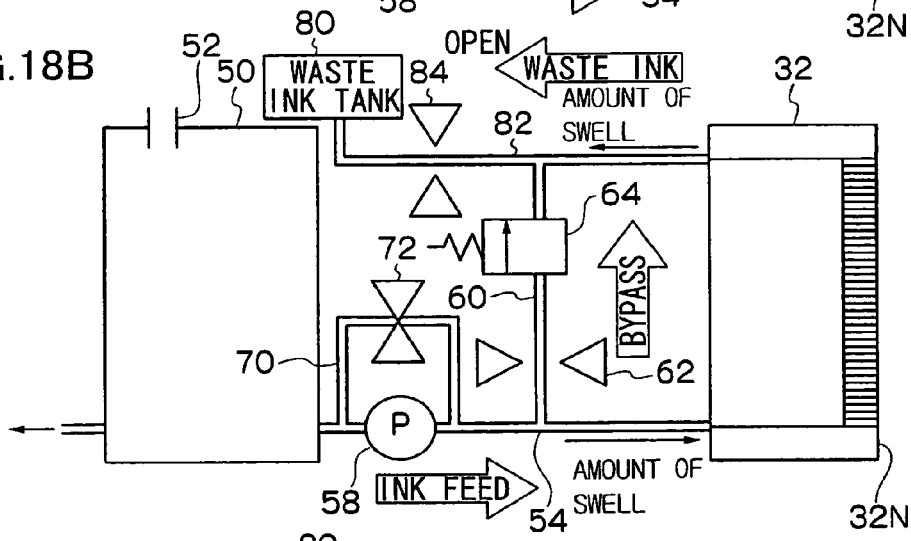
FIG. 18B is a schematic view showing a reservoir tank and ink jet recording heads of an ink jet recording device according to a sixth exemplary embodiment.

FIG. 18(B) shows the action of the ink jet recording device at the time of ink swell. At the ink swell, the open/close valve 62 and the open/close valve 84 are opened, and the bypass valve 72 is closed. And, the circulation pump 58 is driven such that the ink flows from the reservoir tank 50 to the recording head 32, through the circulation outward route 54.

At this moment, the ink flowing through the circulation outward route 54 flows also into the bypass route 60. If the pressure of the ink flowing into the recording head 32 is the relief value of the relief valve 64 or higher, the relief valve 64 is opened, and the ink flows from the bypass route 60 into the circulation homeward route 82.

Thereby, the pressure of the ink flowing into the recording head 32 is kept at a specified value (value that does not destruct the meniscus formed on the nozzle surface), and accordingly, even if the ink swells from the nozzles, there is no fear that the meniscus is destructed and the ink flows out.

Figure 18C:
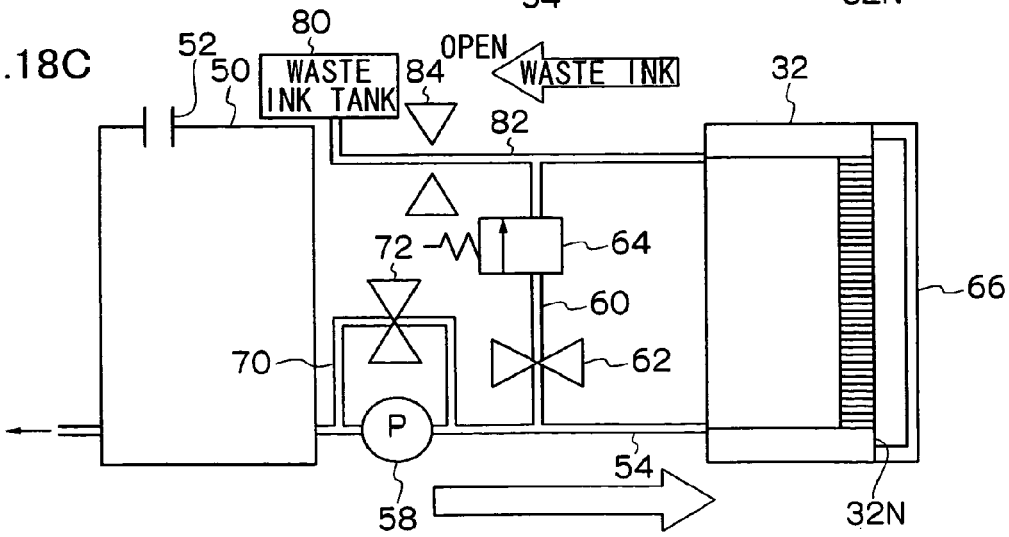
FIG. 18C is a schematic view showing a reservoir tank and ink jet recording heads of an ink jet recording device according to a sixth exemplary embodiment.

FIG. 18(C) shows the action of the ink jet recording device at the time of ink feeding. When the ink is to be fed from the reservoir tank 50 to the recording head 32, the open/close valve 62 and the bypass valve 72 are closed, and the open/close valve 84 is opened, and the cap member 66 is closely attached to the nozzle surface 32N of the recording head 32.

Then, the circulation pump 58 is driven such that the ink flows through the circulation outward route 54, from the reservoir tank 50 toward the recording head 32. Thereby, the ink flows through the circulation outward route 54 from the reservoir tank 50 into the recording head 32, and the ink flows through the circulation homeward route 82 from the recording head 32 into the waste ink tank 80.

Figure 19:
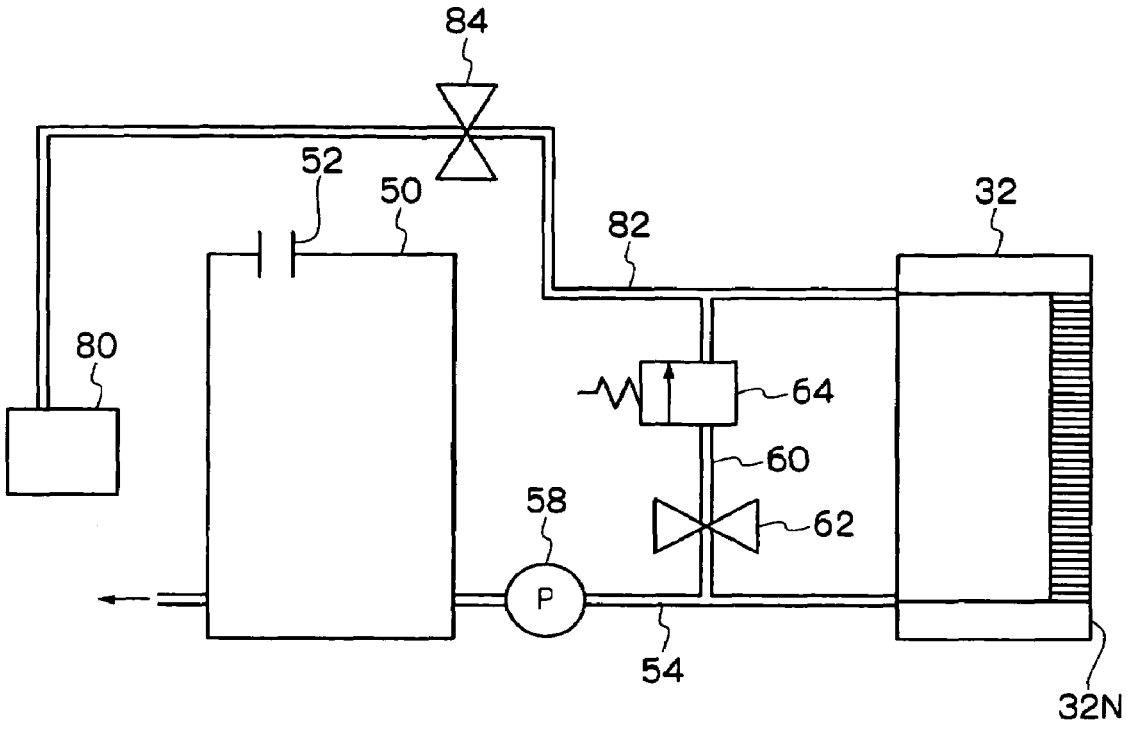
FIG. 19 is a schematic view showing a reservoir tank and ink jet recording heads of an ink jet recording device according to the other exemplary embodiment.

Meanwhile, in the exemplary embodiments, as the circulation pump 58, the tube pump is used that does not let the ink go through at non action state (at the stop of the circulation pump), however, the invention may be applied to an ink jet recording device where a gear pump or the like that lets ink go through at non action state is used as a circulation pump. In the case of using a gear pump or the like, as shown in FIG. 19, in the first exemplary embodiment, a structure may be made where the ink flowing from the reservoir tank 50 into the recording head 32 flows into the waste ink tank 80.

Further, the liquid droplet ejecting head mounted in the liquid droplet ejecting device according to the invention is not limited to the ink jet recording head, but is applicable to general liquid droplet ejecting heads for various industrial applications, including the production of color filters for a display unit by ejecting color inks on high polymer films or glass plates, the formation of bumps for parts packaging by ejecting molten solder onto substrates, the formation of EL display panels by ejecting organic EL solution onto substrates, the formation of bumps for electrical packaging by ejecting molten solder onto substrates, and the like.

Furthermore, in the liquid droplet ejecting device according to the invention, "recording media" as the object for recording image include a wide range of objects as long as a liquid droplet ejecting head can eject liquid droplets onto the object. Accordingly, the recording media include of course recording paper sheets and OHP sheets and the like, but beside these, include for example substrates where wiring patterns are formed and the like.

What is claimed is:

1. A liquid droplet ejecting device comprising:

a liquid droplet ejecting head that ejects a liquid droplet from a nozzle;

a liquid storage unit that stores a liquid to be supplied to the liquid droplet ejecting head;

a first flow path that connects the liquid droplet ejecting head and the liquid storage unit;

a waste liquid tank into which the liquid flows from the liquid droplet ejecting head;

a second flow path that connects the liquid droplet ejecting head and the waste liquid storage tank, and connects with the first flow path in the liquid droplet ejecting head;

a bypass flow path that is connected with the first flow path and the second flow path;

a liquid feed unit that is provided between the liquid storage unit and a connecting portion of the bypass flow path and the first flow path, and feeds the liquid in the liquid storage unit to the liquid droplet ejecting head;

a pressure control unit that is provided at the bypass flow path, and controls pressure of the liquid flowing through the bypass flow path from the first flow path side to the second flow path side;

a liquid feed bypass flow path that is provided at the first flow path, and bypasses the liquid feed unit to connect the liquid storage unit side and the liquid droplet ejecting head side of the first flow path; and a liquid feed open/close valve that is provided at the liquid feed bypass flow path.

2. The liquid droplet ejecting device of claim 1, wherein an open/close valve is provided between the connecting portion and the pressure control unit.

3. The liquid droplet ejecting device of claim 1, wherein an open/close valve is provided at the second flow path.

4. The liquid droplet ejecting device of claim 2, wherein an open/close valve is provided at the second flow path.

5. A liquid droplet ejecting device comprising:

a liquid droplet ejecting head that ejects a liquid droplet from a nozzle;

a liquid storage unit that stores a liquid to be supplied to the liquid droplet ejecting head;

a first flow path that connects the liquid droplet ejecting head and the liquid storage unit;

a second flow path that connects the liquid droplet ejecting head and the liquid storage unit, and connects with the first flow path in the liquid droplet ejecting head;

between the liquid droplet ejecting head and the liquid storage unit, the first flow path and the second flow path are different paths;

a liquid feed unit that is provided at the first flow path and circulates the liquid in the liquid storage unit and the liquid in the liquid droplet ejecting head;

an open/close valve that is provided at the second flow path;

a bypass flow path that is provided at the second flow path, and bypasses the open/close valve to connect the liquid droplet ejecting head side and the liquid storage unit side of the second flow path; and a pressure control unit that is provided at the bypass flow path, and controls pressure of the liquid flowing through the second flow'path.

6. The liquid droplet ejecting device of claim 1, wherein the pressure control unit allows the liquid to flow upon the application of a pressure that is larger than a pressure which causes a breakage of a meniscus formed at a liquid droplet ejecting surface of the liquid droplet ejecting head.

7. The liquid droplet ejecting device of claim 5, wherein the pressure control unit allows the liquid to flow upon the application of a pressure that is larger than a pressure which causes a breakage of a meniscus formed at a liquid droplet ejecting surface of the liquid droplet ejecting head.

8. The liquid droplet ejecting device of claim 1, wherein the pressure control unit makes the liquid flow out from the nozzle when wiping is carried out.

9. The liquid droplet ejecting device of claim 5, wherein the pressure control unit makes the liquid flow out from the nozzle when wiping is carried out.

10. The liquid droplet ejecting device of claim 1, wherein the pressure control unit allows the liquid to flow from the first flow path to the second flow path when a pressure of the liquid flowing from the first flow path to the liquid droplet ejecting head is larger than a predetermined value.

11. The liquid droplet ejecting device of claim 5, wherein the pressure control unit allows the liquid to flow from the liquid droplet ejecting head side to the liquid storage unit side when a pressure of the liquid flowing from the first flow path to the liquid droplet ejecting head is larger than a predetermined value.

* * * * *